US006753487B2

(12) United States Patent
Fujii et al.

(10) Patent No.: US 6,753,487 B2
(45) Date of Patent: Jun. 22, 2004

(54) STATIC RELAY AND COMMUNICATION DEVICE USING STATIC RELAY

(75) Inventors: Mitsuru Fujii, Kyoto (JP); Minoru Sakata, Kyoto (JP); Tomonori Seki, Kyoto (JP); Shobu Sato, Kyoto (JP)

(73) Assignee: Omron Corporation (JP)

( * ) Notice: Subject to any disclaimer, the term of this patent is extended or adjusted under 35 U.S.C. 154(b) by 52 days.

(21) Appl. No.: 10/030,493

(22) PCT Filed: Apr. 23, 2001

(86) PCT No.: PCT/JP01/03486

§ 371 (c)(1),
(2), (4) Date: May 20, 2002

(87) PCT Pub. No.: WO01/82323

PCT Pub. Date: Nov. 1, 2001

(65) Prior Publication Data

US 2002/0163408 A1 Nov. 7, 2002

(30) Foreign Application Priority Data

Apr. 21, 2000 (JP) ..... 2000-121549

(51) Int. Cl.[7] ..... H01H 57/00
(52) U.S. Cl. ..... 200/181
(58) Field of Search ..... 200/181

(56) References Cited

FOREIGN PATENT DOCUMENTS

| | | | |
|---|---|---|---|
| EP | 0 887 879 A1 | 12/1998 | ..... H01Q/3/38 |
| JP | 6-44883 | 2/1994 | |
| JP | 9-92116 | 4/1997 | |
| JP | 9-180616 | 7/1997 | |
| JP | 10-162713 | 6/1998 | |
| JP | 11-74717 | 3/1999 | |

OTHER PUBLICATIONS

Patent Abstracts of Japan, Publication No.: 10–162713, published Jun. 19, 1998, 15 pages.
Patent Abstracts of Japan, Publication No.: 06–044883, published Feb. 18, 1994, 11 pages.
Patent Abstracts of Japan, Publicaton No. 09–092116, published Apr. 4, 1997, 18 pages.
Patent Abstracts of Japan, Publication No. 09–180616, published Jul. 11, 1997, 36 pages.

*Primary Examiner*—Ramon M. Barrera
(74) *Attorney, Agent, or Firm*—Osha & May L.L.P.

(57) ABSTRACT

Fixed contacts (23A, 24A) are provided on the upper surface of a silicon substrate (21). Signal lines (23, 24) electrically continuous with the fixed contacts (23A, 24A) are provided so as to pass through a silicon substrate (21) from the obverse surface to the reverse surface thereof. Bumps (32, 33) electrically continuous with the signal lines (23, 24) are provided on the reverse surface of the silicon substrate (21). A fixed electrode (22) is provided on both sides of the fixed contacts (23A, 24A). Wiring conductors (30, 31) electrically continuous with the fixed electrode (22) are provided so as to pass through the silicon substrate (21) from the obverse surface to the reverse surface thereof. Bumps (34, 35) electrically continuous with the wiring conductors (30, 31) are provided on the reverse surface of the silicon substrate (21). Through holes (26, 27) of the silicon substrate (21) through which the signal lines (23, 24) are passed and through holes (28, 29) of the silicon substrate (21) through which the wiring conductors (30, 31) are passed are hermetically sealed by a movable substrate (40) or a cap (50).

19 Claims, 25 Drawing Sheets fg. 8B

STATIC RELAY AND COMMUNICATION DEVICE USING STATIC RELAY

SPECIFICATION

1. Technical Field of Invention

The present invention relates to a static relay (an electrostatic relay) that opens and closes electrical contacts by driving a movable contact by electrostatic attraction, and a communication device using the relay. More particularly, the present invention relates to a small-size electrostatic microrelay manufactured by using micromachining technology.

2. Background of Invention

As an electrostatic microrelay, one described in the paper "Micro Machined Relay for High Frequency" (Y. Komura, et al.) has previously been known. FIG. 1 is an exploded perspective view showing the structure of this electrostatic microrelay. FIG. 2 is the cross-sectional view schematically showing the structure of the relay. The electrostatic microrelay substantially comprises a stationary substrate 1 and a movable substrate 2. In the stationary substrate 1, two signal lines 5, 6 are formed on a substrate 3. Ends of the signal lines 5, 6 are opposed to each other with a small gap in between, and serve as fixed contacts 5S, 6S, respectively. Fixed electrodes 4A, 4B are disposed on both sides of the signal lines 5, 6. In the movable substrate 2, movable electrodes 9A, 9B are formed, with resilient supporting portions 10A, 10B in between, on both sides of a movable contact 11 formed substantially in the center. Anchors 7A, 7B are provided on the movable electrodes 9A, 9B with resilient bending portions 8A, 8B in between, respectively. The movable substrate 2 is resiliently supported above the stationary substrate 1 by fixing the anchors 7A, 7B onto the stationary substrate 1. The movable electrodes 9A, 9B are opposed to the fixed electrodes 4A, 4B, and the movable contact 11 is opposed so as to straddle the gap between the fixed contacts 5S and 6S.

In this electrostatic microrelay, by applying a voltage between the fixed electrodes 4A, 4B and the movable electrodes 9A, 9B, electrostatic attraction is caused, and by the movable substrate 2 being attracted toward the stationary substrate 1 by the electrostatic attraction, the movable contact 11 makes contact with the fixed contacts 5S, 6S, so that the fixed contacts 5S, 6S are closed to thereby electrically connect the two signal lines 5, 6. Then, by eliminating the electrostatic attraction by removing the voltage, the movable electrodes 9A, 9B are returned to the original shapes by resilience and are separated from the fixed electrodes 4A, 4B, so that the electrical connection between the signal lines 5 and 6 is broken.

An important property of relays is the insertion loss. The insertion loss property shows the degree of signal loss caused between the signal lines when the contacts are closed. Improvement of the insertion loss property means a reduction in the signal loss.

The insertion loss property is determined mainly by the electric resistance of the signal lines and the contact resistance between the contacts. The electric resistance of the signal lines is determined mainly by the width, length and material of the signal lines. The contact resistance between the contacts is determined by the contact force between the fixed contact and the movable contact and the material of the contacts.

To reduce the insertion loss, the above-described electrostatic microrelay operates in the following manner when the contacts are closed: When a voltage is applied between the fixed electrodes 4A, 4B and the movable electrodes 9A, 9B, electrostatic attraction is caused between the fixed electrodes 4A, 4B and the movable electrodes 9A, 9B. Then, the resilient bending portions 8A, 8B bend, so that the movable electrodes 9A, 9B approach the fixed electrodes 4A, 4B and the movable contact 11 is attached to the fixed contacts 5S, 6S. At this time, since the distance between the movable electrodes 9A, 9B and the fixed electrodes 4A, 4B is shorter than the initial one, the movable substrate 2 is attracted by a larger electrostatic attraction, so that the resilient supporting portions 10A, 10B bend. Consequently, the movable contact 11 makes contact with the fixed contacts 5S, 6S with an insulating layer in between. Since the resilient supporting portions 10A, 10B have a larger resilience than the resilient bending portions 8A, 8B, the movable contact 11 is pressed onto the fixed contacts 5S, 6S with a heavy load.

Since the electrostatic microrelay thus has a strong contact force between the contacts, the contact resistance between the contacts is reduced, so that the insertion loss is reduced. Moreover, an excellent insertion loss property is realized by using a low-resistance material such as gold (Au) for the signal lines and the fixed and movable contacts.

Moreover, a mounting configuration of the above-described electrostatic microrelay is such that, as shown in FIG. 3, the electrostatic microrelay is connected to the lead frames 12 by bonding wires 13 so that the fixed electrodes 4A, 4B, the movable electrodes 9A, 9B, the fixed contacts 5S, 6S, the movable contact 11 and the like are made electrically continuous with the lead frames 12, then the electrostatic microrelay is sealed in a molded package.

However, in the electrostatic microrelay with the above-described structure and mounting configuration, since the mounting configuration uses the lead frames 12 and the bonding wires 13, the mounting area of the electrostatic relay in the mounting configuration is large compared to the chip size and the signal line length is large, so that the insertion loss increases to degrade the high-frequency property.

In the above-described electrostatic microrelay, the insertion loss of the relay can further be reduced by suppressing the electric resistance of the signal lines by the shortening signal line length by reducing the size of the electrostatic microrelay.

However, when the size of the electrostatic microrelay is reducing, the areas of the movable and fixed electrodes are also reduced, so that the electrostatic attraction that acts between the electrodes decreases. This decreases the contact force between the contacts. Consequently, the contact resistance between the contacts increases to increase the insertion loss.

As described above, in the electrostatic microrelay of the conventional structure, since there is a tradeoff relationship between the electric resistance of the signal lines and the contact force between the contacts, size reduction of the electrostatic microrelay does not always improve the insertion loss of the electrostatic microrelay.

SUMMARY OF THE INVENTION

An object of the present invention is to provide an electrostatic relay capable of reducing the insertion loss irrespective of the size of the relay and the contact resistance between the contacts. Another object is to provide an electrostatic relay capable of reducing the insertion loss without degrading the reliability of the contacts. Still another object is to provide a communications apparatus using the relay.

In an electrostatic relay of the present invention in which a movable electrode of a movable substrate resiliently supported so as to be opposed to a fixed electrode formed on a stationary substrate is driven based on electrostatic attraction caused between the fixed electrode and the movable electrode, and a plurality of fixed contacts provided on the stationary substrate and a movable contact provided on the movable substrate are brought into contact with each other and separated from each other; a sealing portion formed on a third substrate is provided that constitutes a portion that crosses a line connecting the fixed contacts and the movable contact outside a gap between the fixed contacts and the movable contact, and seals at least the fixed contacts and the movable contact by bonding them to the stationary substrate or to the movable substrate, and a through portion in which at least one of the signal lines connecting to the fixed contacts is passed through the stationary substrate from an obverse surface to a reverse surface thereof and is disposed in a position not deteriorating a sealing condition of the sealing portion.

According to the electrostatic relay of the present invention, since the signal lines are passed through the through portion formed so as to pass through the stationary substrate from the obverse surface to the reverse surface thereof, the signal lines provided in the through portion can be directed to the lower surface of the stationary substrate. Consequently, the electrostatic relay is small in size compared to a case where lead frames or the like are used. Moreover, since the signal line length can be shortened, the insertion loss of the electrostatic relay can be reduced, so that an excellent high frequency property can be obtained.

Consequently, according to the electrostatic relay of the present invention, even when the size of the electrostatic relay is the same, the insertion loss can be reduced by reducing the electric resistance of the signal lines by shortening the signal line length. Moreover, according to the electrostatic relay, the electric resistance of the signal lines is suppressed without the contact resistance between the contacts increased, so that the insertion loss property of the electrostatic relay can be improved.

Moreover, according to the electrostatic relay of the present invention, since the fixed contacts and the movable contact are sealed by the third substrate, the atmosphere (kind of gas, degree of vacuum) in the gap between the fixed contacts and the movable contact can be controlled by atmosphere setting at the time of bonding to the stationary substrate, the movable substrate and the like. Further, since the fixed contacts and the movable contact are protected by the sealing, intrusion of foreign objects from outside and deterioration caused by corrosive gases can be prevented, so that reliability and the life of the relay can be improved.

In an embodiment of the present invention, at least one of the signal lines connecting to the fixed contacts is passed through the stationary substrate from the obverse surface to the reverse surface thereof, and an opening, on a movable substrate bonded side, of a through hole through which the signal line is passed is hermetically sealed by bonding it to the movable substrate or to the third substrate through a metal layer formed around the opening. According to this embodiment, since the through hole is used as the through portion where the signal line is provided, the degree of freedom of the position where the through portion is disposed increases. Further, according to this embodiment, since the number of signal lines formed on the stationary substrate is reduced, the areas of the fixed electrode and the movable electrode can be increased without the size of the electrostatic relay increased. Since this increases the electrostatic attraction acting between the fixed electrode and the movable electrode, the contact pressure of the movable contact and the fixed contacts increases, so that the insertion loss of the electrostatic relay can be reduced. Moreover, the driving voltage of the movable substrate can be suppressed by increasing the fixed electrode and the movable electrode in size.

In another embodiment of the present invention, at least one of the signal lines passed through the stationary substrate from the obverse surface to the reverse surface thereof may be formed vertically to the stationary substrate. By forming at least one of the signal lines provided on the stationary substrate vertically to the stationary substrate, the length of the signal line is minimized, so that the effect of improving the insertion loss property can be maximized.

In still another embodiment of the present invention, at least one of wiring conductors provided on the stationary substrate, except for the signal lines connecting to the fixed electrodes being passed through the stationary substrate from the obverse surface to the reverse surface thereof, and an opening on the movable substrate bonded side of a through hole through which the wiring conductor is passed, is hermetically sealed by bonding it to the movable substrate or to the third substrate through a metal layer formed around the opening. According to this embodiment, since the wiring conductor area on the stationary substrate is reduced, the area of the electrostatic relay can be reduced. Moreover, since the fixed contacts and the movable contact are protected by the sealing, intrusion of foreign objects from outside and deterioration caused by corrosive gases can be prevented, so that reliability and the life of the relay can be improved.

In still another embodiment of the present invention, at least one ground line for a high frequency is formed between at least one pair of signal lines or wiring conductors of the signal lines or the wiring conductors formed on the stationary substrate. According to this embodiment, since the capacitive coupling between the signal lines or the wiring conductors can be suppressed by connecting the signal lines or the wiring conductors by the ground line for a high frequency, the isolation property of the electrostatic relay improves.

The isolation property shows the degree of signal leakage caused between the signal lines when the contacts are opened. Improvement of the isolation property indicates reduction in signal leakage.

In an electrostatic relay according to still another embodiment of the present invention, at least one of the signal lines or the wiring conductors is formed in the through hole formed in the stationary substrate, and at least part of the signal line or the wiring conductor is formed only on part of the through hole. According to this embodiment, even when the signal lines or the wiring conductors are opposed to each other, the capacitive coupling between the signal lines or the wiring conductors can be suppressed by partially removing the opposing parts of the signal lines or the wiring conductors, so that the isolation property of the electrostatic relay can be improved.

According to still another embodiment of the present invention, a bump is provided at an end situated on a substrate reverse surface side of at least one of the signal lines or the wiring conductors formed on the stationary substrate. According to this embodiment, since the bump is provided on the reverse surface of the stationary substrate, the electrostatic relay can directly be mounted on the circuit board by the bump. Moreover, since it is unnecessary to form wire pads on the stationary substrate, the element can be reduced in size. In general, a higher packaging density can be realized. Further, since no wire is used, the insertion loss property can be improved.

According to still another embodiment of the present invention, the opening is disposed outside an area on the stationary substrate opposed to the movable electrode or the movable contact. According to this embodiment, since the opening does not overlap the movable electrode or the movable contact, the member for closing the opening does not readily interfere with the movable electrode or the movable contact, so that the degree of freedom of the member for closing the opening increases.

According to still another embodiment of the present invention, the third substrate is bonded to the stationary substrate by a convex portion formed on a side bonded to the stationary substrate. According to this embodiment, since the third substrate has a convex portion for bonding to the stationary substrate, the movable contact and the fixed contacts can be sealed in the concave portion surrounded by the convex portion, so that a simple sealing structure can be realized.

According to still another embodiment of the present invention, at least one of the openings is disposed in a position opposed to the convex portion of the third substrate. According to this embodiment, since the opening can be closed by the convex portion provided on the third substrate, the number of members can be reduced, so that assembly of the electrostatic relay can be facilitated and the cost is reduced.

According to still another embodiment of the present invention, since the through portion is disposed in a peripheral part of the stationary substrate, the through portion can be processed easily. In particular, when the through portion has a concave shape having an opening on a periphery of the stationary substrate, the through portion can be processed more easily. For example, even when the stationary substrate is made of a glass substrate or the like, the through portion can be provided by a method such as sandblasting.

According to still another embodiment of the present invention, since the through portion is formed vertically to a plane of the stationary substrate, the effect of improving the insertion loss property can be maximized.

According to still another embodiment of the present invention, since the third substrate is bonded to the stationary substrate and the through portion is provided on the stationary substrate in a neighborhood outside an area of bonding of the stationary substrate and the third substrate, the sealing structure between the stationary substrate and the third is never deteriorated by the through portion.

According to still another embodiment of the present invention, since at least one of the wiring conductors formed on the stationary substrate is connected to the through portion, not only the signal line length but also the wiring conductor length can be shortened, so that noise resistance increases and the operation of the movable electrode is stabilized.

According to still another embodiment of the present invention, since an electrode film is provided on the reverse surface of the stationary substrate and the reverse surface electrode film is divided into a plurality of areas isolated from each other, by a slit formed on the reverse surface of the stationary substrate, the steps of manufacturing the reverse surface electrode film are simple compared to a case where the reverse surface electrode film is independently formed.

According to still another embodiment of the present invention, since a bump electrically continuous with at least one of the signal lines or the wiring conductors formed on the stationary substrate is provided on the reverse surface of the stationary substrate, the electrostatic relay can be surface-mounted by the bump, so that no lead frame or the like is necessary for mounting.

The stationary substrate and the movable substrate according to still another embodiment of the present invention are made of single-crystal silicon. It is preferable that the stationary substrate and the movable substrate be both made of single-crystal silicon, as all of the steps of manufacturing the electrostatic relay can be almost entirely processed by semiconductor processing steps.

The electrostatic relay of the present invention which is small in insertion loss and excellent in high frequency property is particularly suitable for use in a communications apparatus as a switching element switching transmission/reception signals of an antenna or an internal circuit.

The above-described elements of the present invention may be arbitrarily combined as far as possible.

DETAILED DESCRIPTION OF THE INVENTION

Preferred embodiments of the present invention will be described in detail with reference to the drawings.

Figure 1:
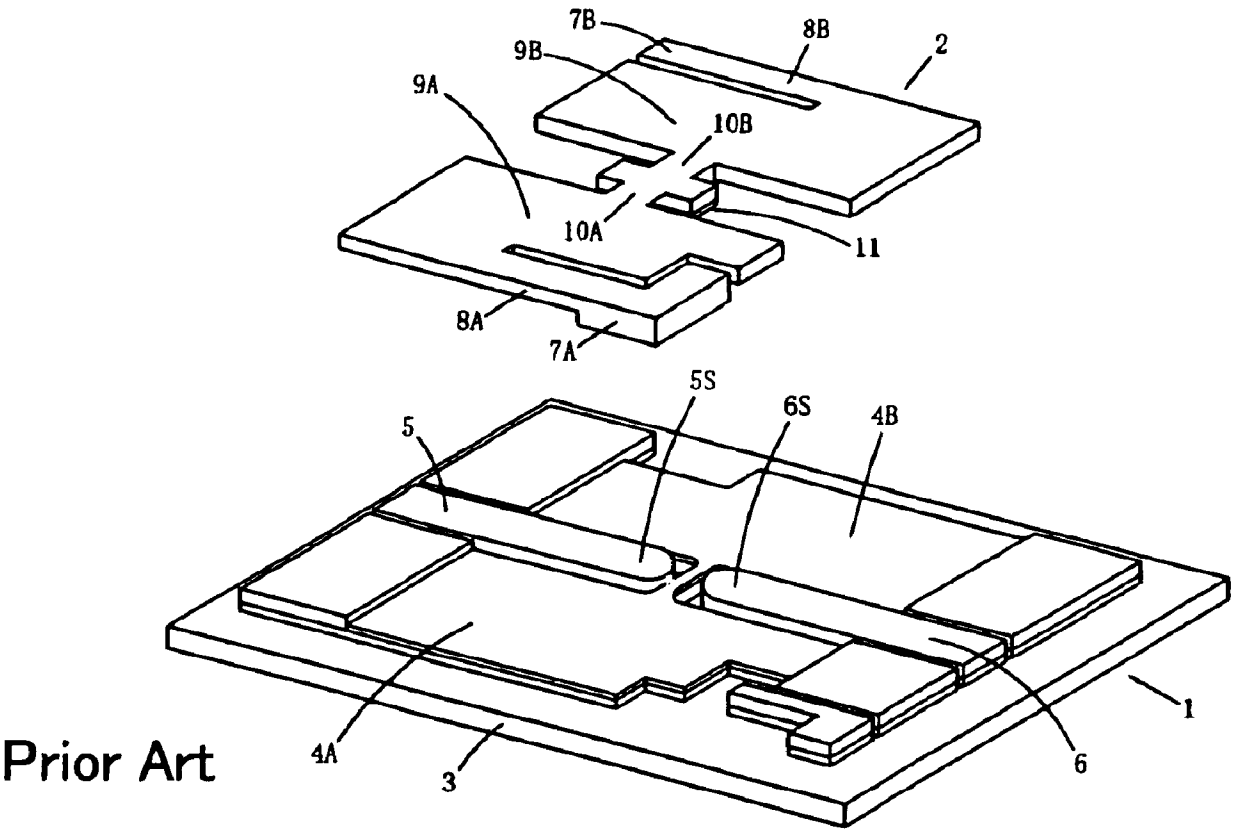
Prior Art fig. 1
FIG. 1 is an exploded perspective view showing the structure of the conventional electrostatic microrelay.
Figure 2:
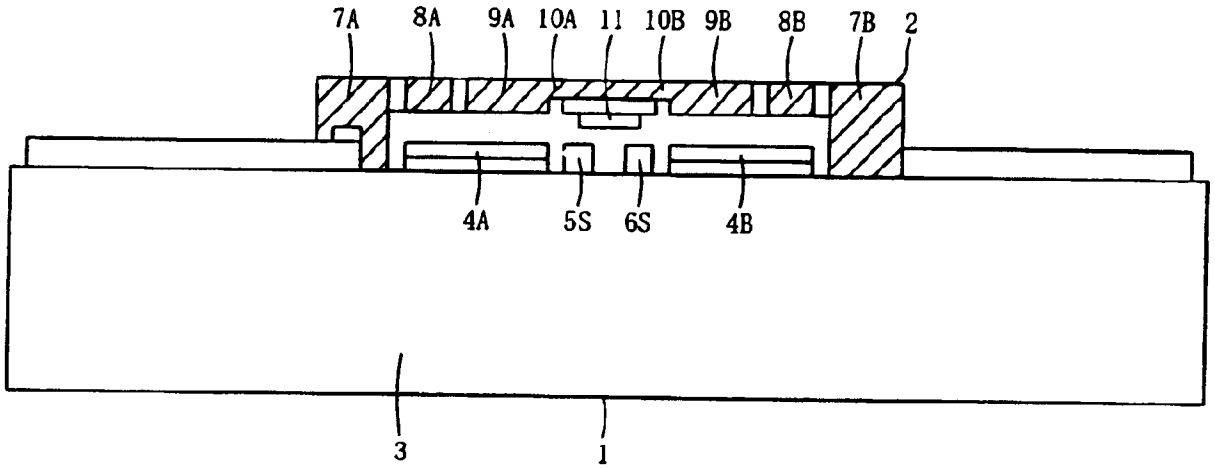
fig. 2 Prior Art
FIG. 2 is a cross-sectional view schematically showing the structure of the electrostatic microrelay shown in FIG. 1.
Figure 3:
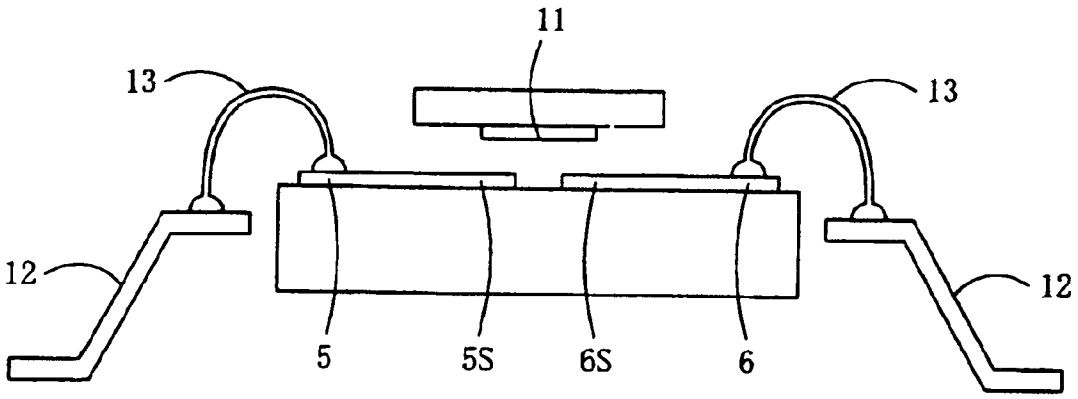
fig. 3 Prior Art
FIG. 3 is a schematic view explaining a mounting configuration of the electrostatic microrelay shown in FIG. 1.
Figure 4:
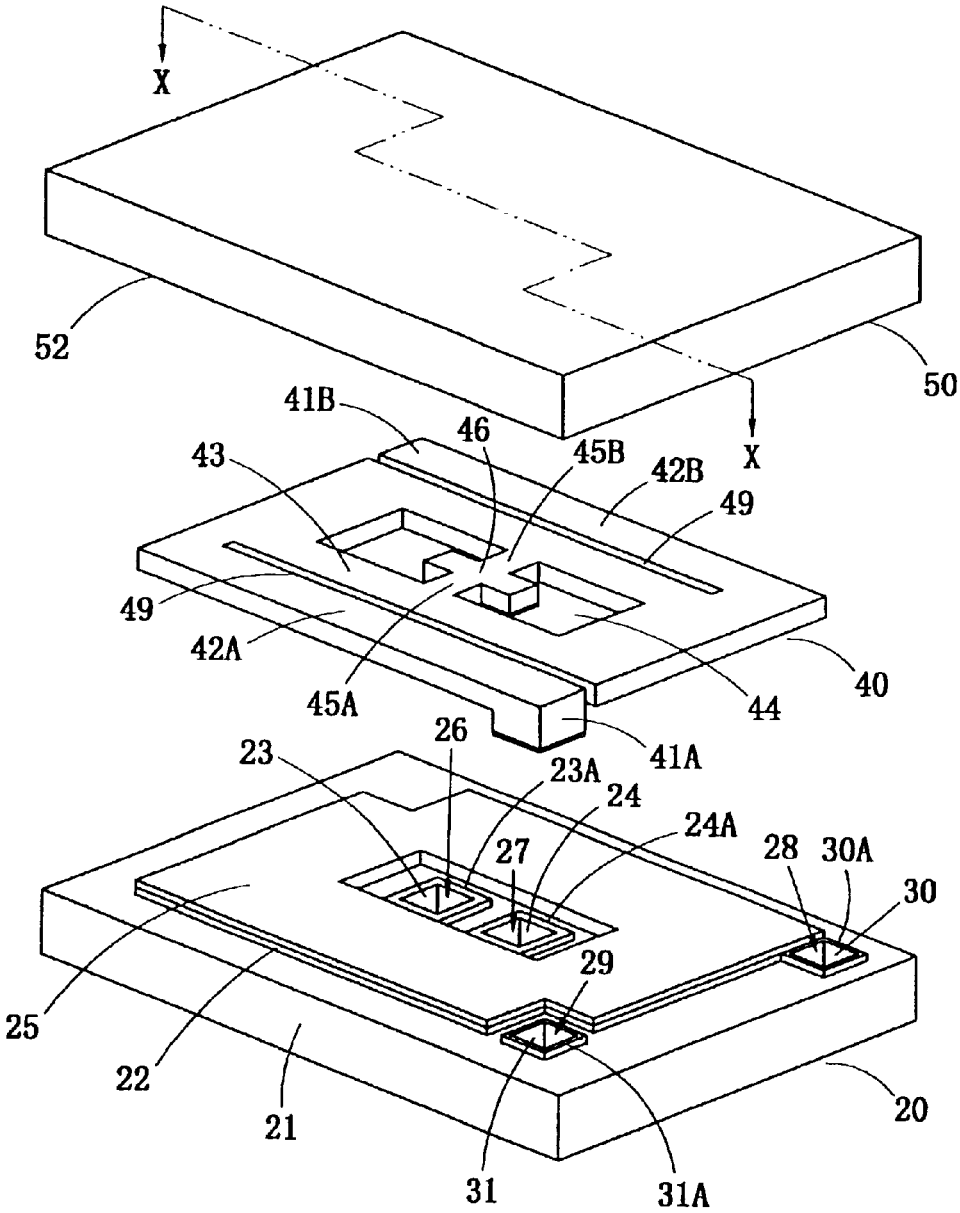
FIG. 4 is an exploded perspective view of an electrostatic microrelay according to an embodiment of the present invention.
Figure 5:
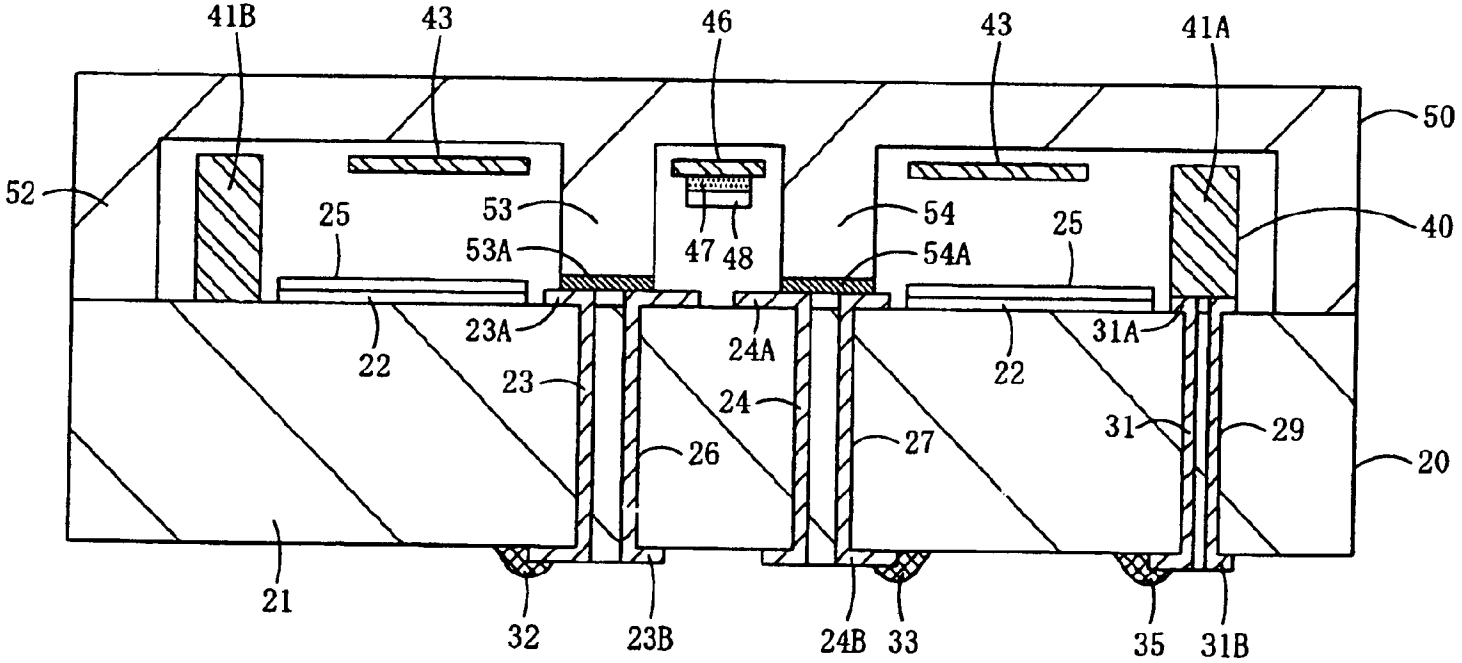
FIG. 5 is a cross-sectional view taken on the line X—X of FIG. 4.
Figure 6:
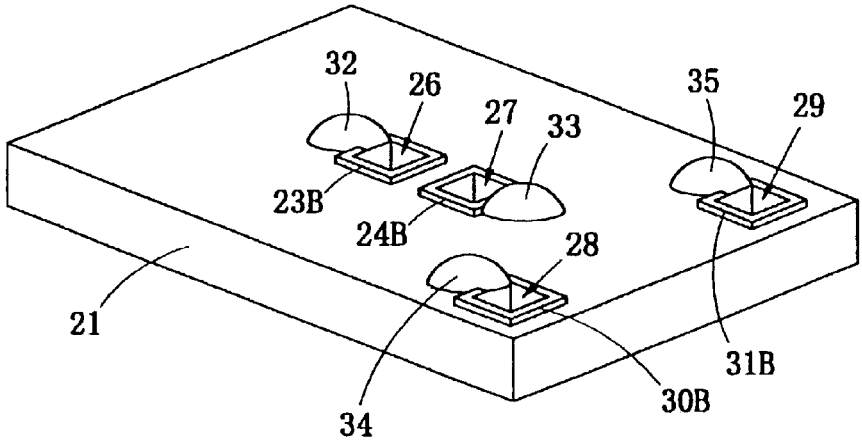
FIG. 6 is a perspective view of a stationary substrate used in the electrostatic microrelay of FIG. 4 when viewed from the reverse surface side.
Figure 7:
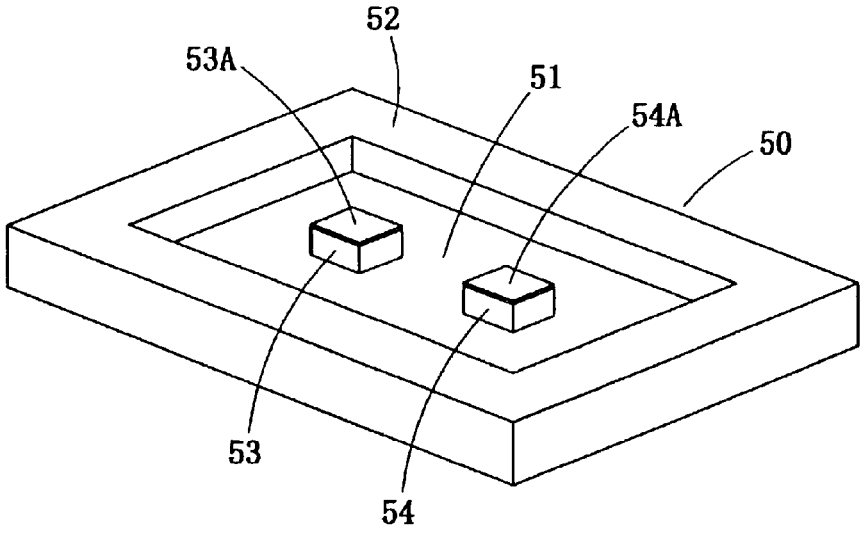
FIG. 7 is a perspective view of a cap used in the electrostatic microrelay of FIG. 4 when viewed from the reverse surface side.

FIG. 4 is an exploded perspective view showing the structure of an electromagnetic microrelay according to an embodiment of the present invention. FIG. 5 is a stepped cross-sectional view taken on the line X—X of FIG. 4. The electrostatic microrelay mainly comprises a stationary substrate 20, a movable substrate 40, and a cap 50. The movable substrate 40 is attached to the upper surface of the stationary substrate 20 so as to be integrated therewith. The upper surface of the stationary substrate 20 and the movable substrate 40 are sealed between the stationary substrate 20 and the cap 50. FIG. 6 is a perspective view of the stationary substrate 20 viewed from the reverse surface side. FIG. 7 is a perspective view of the cap 50 viewed from the inner surface side.

As shown in FIG. 4, in the stationary substrate 20, a fixed electrode 22 and a pair of fixed contacts (23A, 24A) are provided on the upper surface of a silicon substrate 21 having its surface thermally oxidized. The surface of the fixed electrode 22 is coated with an insulating film 25. Moreover, in the stationary substrate 20, signal lines 23, 24 and wiring conductors 30, 31 (through hole wiring conductors) are formed that comprise metal coatings provided on the inner surfaces of through holes 26, 27, 28, 29 formed in the silicon substrate 21. On the upper surface of the silicon substrate 21, lands 23A, 24A, 30A, 31A are formed at edges of the signal lines 23, 24 and the wiring conductors 30, 31, respectively. On the lower surface of the silicon substrate 21, as shown in FIG. 6, lands 23B, 24B, 30B, 31B electrically continuous with the signal lines 23, 24 and the wiring conductors 30, 31, respectively, are provided, and connection bumps 32, 33, 34, 35 electrically continuous with the lands 23B, 24B, 30B, 31B, respectively, are provided. The fixed electrode 22 is electrically continuous with the land 30A, and is connected to the connection bump 34 through the wiring conductor 30 and the land 30B. The lands 23A, 24A are fixed contacts of the stationary substrate 20 (hereinafter, the lands 23A, 24A will be referred to as fixed contacts 23A, 24A). The fixed contacts 23A, 24A are connected to the connection bumps 32, 33 through the signal lines 23, 24.

In the movable substrate 40 which is formed by processing a silicon substrate, a substantially rectangular movable electrode 43 is resiliently supported by anchors 41A, 41B through resilient bending portions 42A, 42B, and a movable contact portion 46 is resiliently supported through resilient supporting portions 45A, 45B in openings 44 formed inside the movable electrode 43. The resilient bending portions 42A, 42B are formed by slits 49 formed along both side edges of the movable substrate 40. The anchors 41A, 41B protrude downward from ends of the resilient bending portions 42A, 42B, respectively. The resilient supporting portions 45A, 45B and the movable contact portion 46 are formed by the openings 44 formed on both sides in the center of the movable electrode 43. The resilient supporting portions 45A, 45B are narrow beams coupling the movable electrode 43 and the movable contact portion 46, and are structured so that a larger resilience than that of the resilient bending portions 42A, 42B is obtained when the contacts are closed. In the movable contact portion 46, a movable contact 48 made of metal is provided, with an insulating film 47 in between, on the lower surface of a flat portion (silicon substrate portion) 46A directly supported by the resilient supporting portions 45A, 45B.

The movable substrate 40 is mounted on the stationary substrate 20 in the following manner: The anchors 41A, 41B protruding downward are fixed at two positions on the upper surface of the stationary substrate 20, whereby the movable electrode 43 is supported so as to be floated above the stationary substrate 20. At this time, one anchor 41A is bonded onto the land 31A of the stationary substrate 20 to hermetically seal the through hole 29. Consequently, the movable electrode 43 is electrically connected to the connection bump 35 provided on the reverse surface of the stationary substrate 20 with the wiring conductor 31 in between. The other anchor 41B is bonded to the upper surface of the silicon substrate 21 in a position isolated from the fixed electrode 22 and the like.

In a condition where the movable substrate 40 is mounted on the stationary substrate 20, the movable electrode 43 is opposed to the fixed electrode 22 with the insulating film 25 in between. When a voltage is applied between the electrodes 22 and 43 through the connection bumps 34, 35 and the wiring conductors 30, 31, the movable electrode 43 is attracted to the fixed electrode 22 by the electrostatic attraction caused between the fixed electrode 22 and the movable electrode 43. The movable contact 48 is opposed to the fixed contacts 23A, 24A, and makes contact with the fixed contacts 23A, 24A to thereby close the fixed contacts 23A, 24A, so that the signal lines 23, 24 are electrically connected. However, the movable contact 48 does not overhang the through holes 26, 27 and makes contact only with a part of the lands so as not to interfere with fixed contact sealing portions 53, 54 described later.

The cap 50 is made of a glass substrate such as Pyrex. As shown in FIG. 7, a concave portion 51 is formed on the lower surface of the cap 50. A gap sealing portion 52 is formed on the periphery of the lower surface of the cap 50. The fixed contact sealing portions 53, 54 are provided inside the gap sealing portion 52. Metal films 53A, 54A are provided on the lower surfaces of the fixed contact sealing portions 53, 54. The gap sealing portion 52 is hermetically fixed to the upper surface of the periphery of the stationary substrate 20, and hermetically seals the through hole 28 where the land 30A is provided. The fixed contact sealing portions 53, 54 are hermetically fixed onto the fixed contacts 23A, 24A so as to close the through holes 26, 27 where the fixed contacts 23A, 24A are provided. Since the anchor 41A of the movable substrate 40 closes the through hole 29 of the land 31A, the fixed electrode 22, the movable substrate 40 and the like on the upper surface of the stationary substrate 20 are hermetically sealed between the stationary substrate 20 and the cap 50 to be protected from dust and corrosive gases.

Next, the operation of the electrostatic microrelay will be described with reference to FIG. 8. In a condition where no voltage is applied between the fixed electrode 22 and the movable electrode 43, as shown in FIG. 8(*a*), the stationary substrate 20 and the movable substrate 40 are kept parallel to each other, and the movable contact 48 is separated from the fixed contacts 23A, 24A.

When a voltage is applied between the movable electrode 43 and the fixed electrode 22 from the connection bumps 34, 35, electrostatic attraction is caused between the electrodes 22 and 43. Consequently, as shown in FIG. 8(*b*), the movable electrode 43 approaches the fixed electrode 22 against the resilience of the resilient bending portions 42A, 42B, so that the movable contact 48 abuts against the fixed contacts 23A, 24A.

Figure 8A:
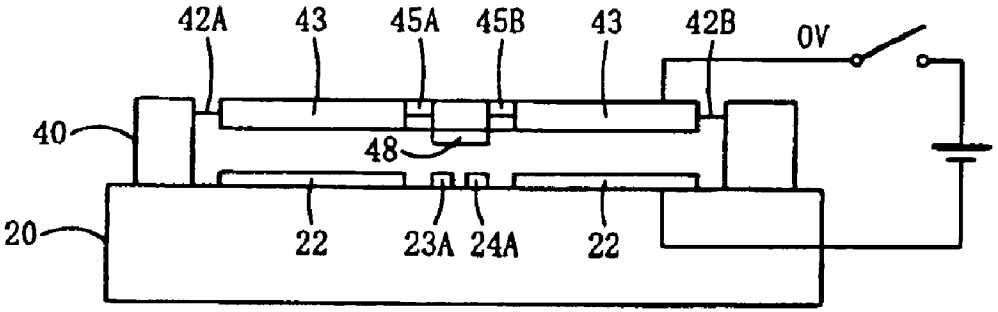
FIGS. 8(*a*), 8(*b*) and 8(*c*) are schematic cross-sectional views for explaining the operation of the electrostatic microrelay shown in FIG. 4.
Figure 8C:
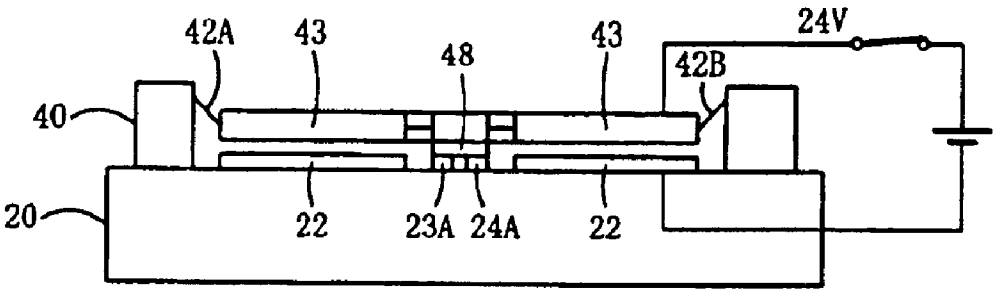
Figure 8C:
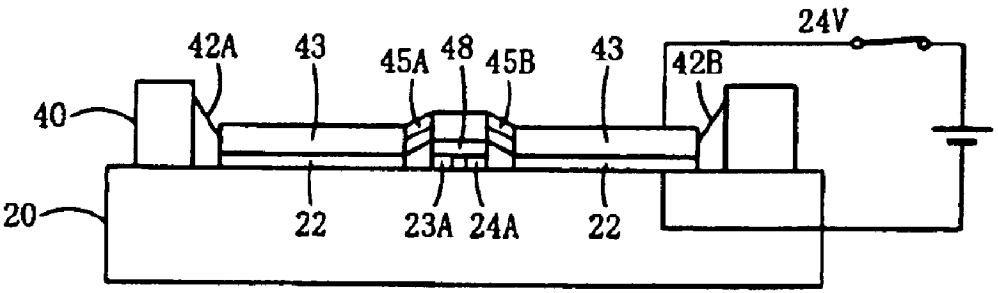
Figure 9A:
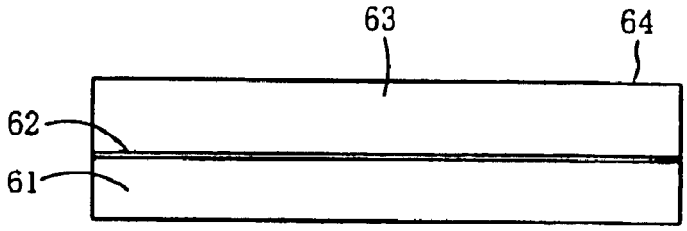
FIG. 9(*a*) through FIG. 9(*e*) are schematic views explaining the steps of manufacturing an intermediate product of a movable substrate.
Figure 9B:
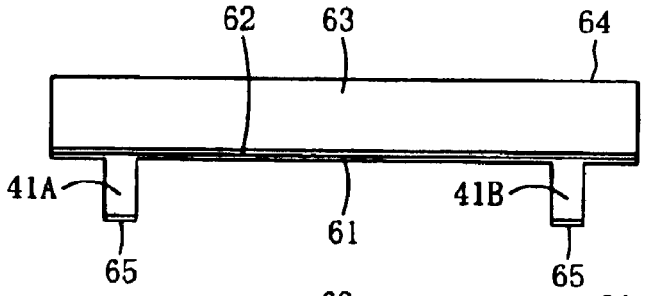
Figure 9C:
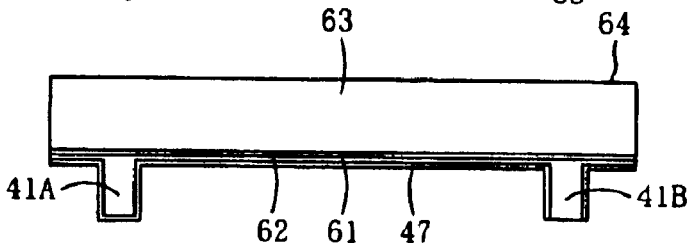
Figure 9D:
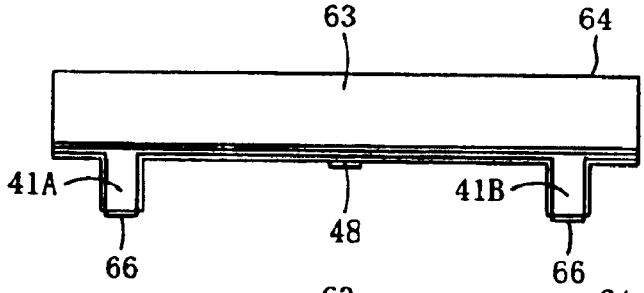
Figure 9E:
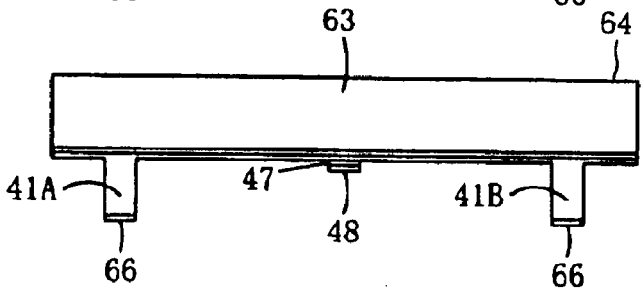
Figure 10A:
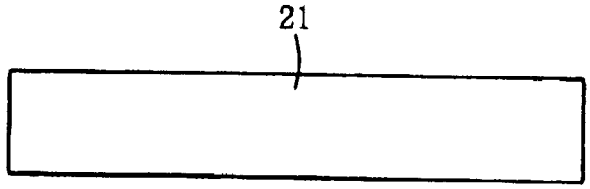
FIG. 10(*a*) through FIG. 10(*e*) are schematic views explaining the steps of manufacturing the stationary substrate.
Figure 10B:
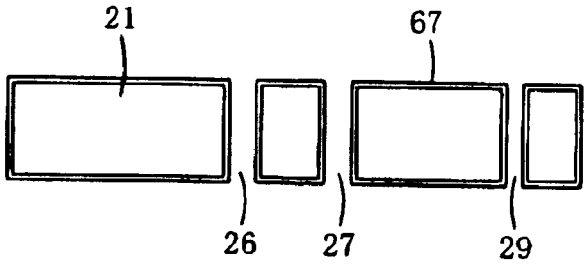
Figure 10C:
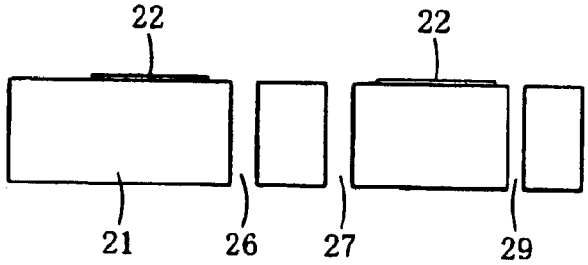
Figure 10D:
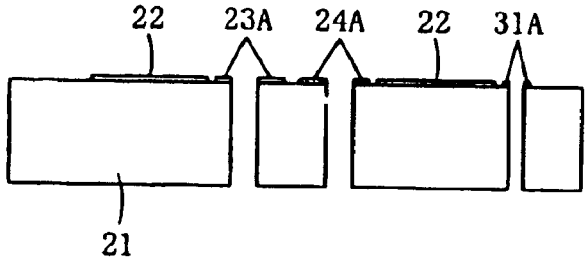
Figure 10E:
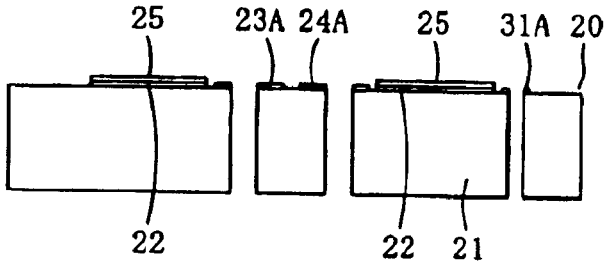

As shown in FIG. 8(*c*), even after the movable contact 48 abuts against the fixed contacts 23A, 24A, the movable electrode 43 continues moving until abutting against the insulating film 25 on the fixed electrode 22. The movable contact 48 exerts a resilience corresponding to the amount of bend of the resilient supporting portions 45A, 45B on the fixed contacts 23A, 24A to increase the contact pressure, so that the movable substrate 40 uniformly abuts against the stationary substrate 20. As a result, a desired contact reliability is obtained when the contacts are closed.

When the applied voltage is removed, the movable electrode 43 is separated from the fixed electrode 22 by the resiliences of both of the resilient bending portions 42A, 42B and the resilient supporting portions 45A, 45B. Because of this, the separating operation is performed with reliability. Thereafter, the movable electrode 43 continues moving upward by the resilience of only the resilient bending portions 42A, 42B, and the movable contact 48 is separated from the fixed contacts 23A, 24A to return to its initial state.

Next, a method for manufacturing the electrostatic microrelay having the above-described structure will be described with reference to FIG. 9 through FIG. 10. First, an intermediate product of the movable substrate 40 is made according to the steps of FIG. 9. That is, as shown in FIG. 9(*a*), an SOI (Silicon On Insulator) wafer 64 comprising an Si layer 61, an $SiO_2$ layer (oxide film) 62 and an Si layer 63 from below is prepared. Then, to form the anchors 41A, 41B on the lower surface of the Si layer 61, the lower surface of the Si layer 61 is wet-etched, for example, with a silicon oxide film 65 as a mask and TMAH as the etchant, thereby forming the anchors 41A, 41B protruding downward as shown in FIG. 9(*b*). Then, as shown in FIG. 9(*c*), after the insulating film 47 made of $SiO_2$ is formed by thermally oxidizing the lower surface of the silicon layer 61, the lower surface of one anchor 41A is exposed from the insulating film 47, and P (phosphorus) is poured into the exposed surface to form a conductive layer. Then, as shown in FIG. 9(*d*), after the lower surface of the other anchor 41B is opened, a metal film 66 of Au or the like is provided on the lower surface of each of the anchors 41A, 41B, and at the same time, the movable contact 48 of Au or the like is formed on the insulating film 47 substantially in the center of the lower surface of the Si layer 61. Then, the insulating film 47 is removed by etching. The insulating film 47 on the lower surface of the movable contact 48 is left without being etched, because it is covered with the movable contact 48. Consequently, a two-layer structure of the insulating film 47 and the movable contact 48 is formed.

Next, the stationary substrate 20 is formed according to the steps of FIG. 10. That is, the silicon substrate 21 as shown in FIG. 10(*a*) is prepared, and the through holes 26, 27, 28, 29 are formed in four positions by deep-etching the silicon substrate 21. As shown in FIG. 10(*b*), an insulating coating 67 of $SiO_2$ is formed on the surface of the silicon substrate 21 by thermally oxidizing the silicon substrate 21. Then, by depositing an electrode metal on the insulating coating 67 and patterning the electrode metal, the fixed electrode 22 is formed in each fixed electrode formed position as shown in FIG. 10(*c*). Likewise, the fixed contacts 23A, 24A and the lands 30A, 31A are formed by use of Au or the like at the edges of the through holes 26, 27, 28, 29 by photolithography as shown in FIG. 10(*d*). Then, the surface of the fixed electrode 22 is covered with the insulating film 25 as shown in FIG. 10(*e*) to complete the stationary substrate 20.

Figure 11A:
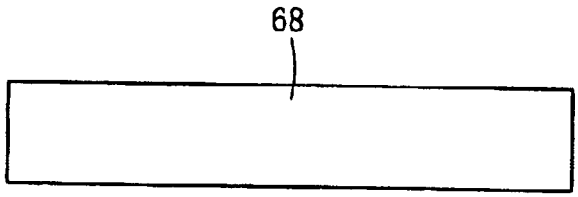
FIGS. 11(*a*) and 11(*b*) are schematic views explaining the steps of manufacturing the cap.
Figure 11B:
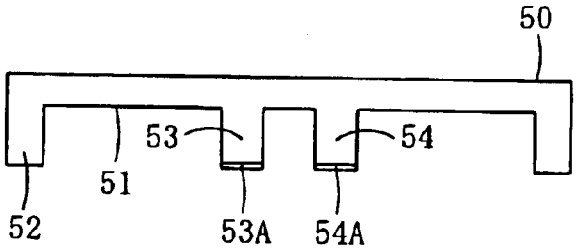
Figure 12A:
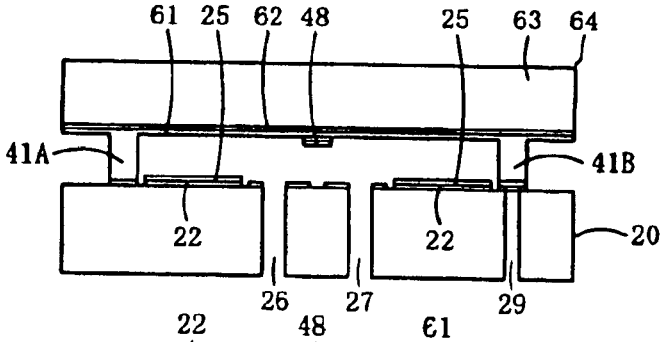
FIG. 12(*a*) through FIG. 12(*e*) are schematic views explaining the steps of manufacturing the electrostatic microrelay by joining together the movable substrate, the stationary substrate and the cap manufactured according to the steps of FIG. 9 through FIG. 11.
Figure 12B:
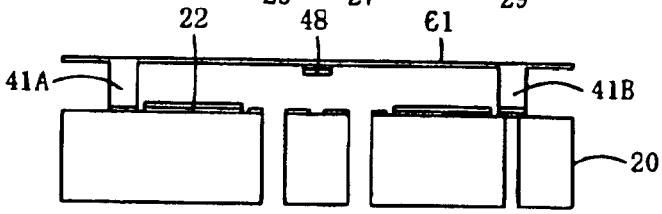
Figure 12C:
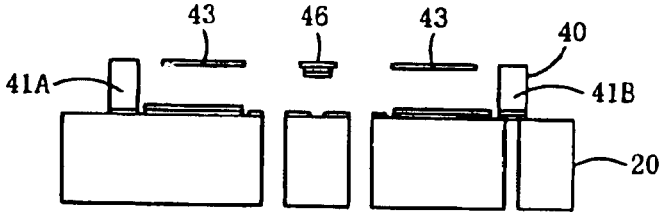
Figure 12D:
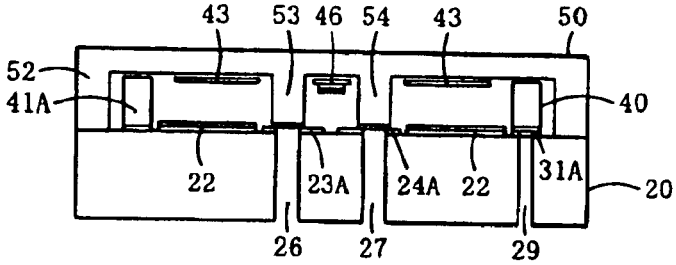
Figure 12E:
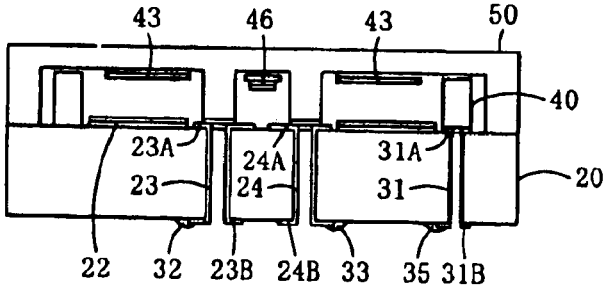

The cap 50 is formed according to the steps of FIG. 11. The fixed contact sealing portions 53, 54 are formed on the lower surface of a prepared glass substrate 68 as shown in FIG. 11(*a*). For example, the glass substrate 68 is wet-etched from below with Cr as the mask and HF as the etchant to thereby form the concave portion 51 on the lower surface of the glass substrate 68. Therefore, the gap sealing portion 52 is provided on the periphery of the lower surface of the glass substrate 68, and the fixed contact sealing portions 53, 54 protruding downward are formed. Then, the metal films 53A, 54A of Au or the like are formed on the lower surface of the fixed contact sealing portions 53, 54 to complete the cap 50 as shown in FIG. 11(*b*).

Then, as shown in FIG. 12(*a*), the anchors 41A, 41B of the SOI wafer 64 are integrally bonded onto the stationary substrate 20 by Au/Au bonding or the like. Then, as shown in FIG. 12(*b*), the upper surface of the SOI wafer 64 is etched with an alkaline etchant such as TMAH or KOH. The upper surface of the SOI wafer 64 is etched until the $SiO_2$ layer 62 is reached so that the $SiO_2$ layer 62 is exposed. Consequently, the Si layer 61 which is thin is formed above the stationary substrate 20 except for parts of the anchors 41A, 41B.

Then, after the oxide film 62 on the Si layer 61 is removed by use of a fluorine etchant so that the Si layer 61 that becomes the movable contact 43 is exposed, the unnecessary parts on the periphery is removed by performing mold etching by dry etching using RIE or the like, and the slits 49 and the openings 44 are provided to form the resilient bending portions 42A, 42B, the resilient supporting portions 45A, 45B and the movable contact portion 46 to complete the movable substrate 40 on the stationary substrate 20 as shown in FIG. 12(*c*).

Then, as shown in FIG. 12(*d*), the cap 50 is placed over the stationary substrate 20 integrally bonded to the movable substrate 40, and the fixed contact sealing portions 53, 54 are integrally bonded to the fixed contacts 23A, 24A by Au/Au bonding or the like and the gap sealing portion 52 is integrally bonded to the periphery of the upper surface of the stationary substrate 20 and the land 30A. Then, the signal lines 23, 24 and the wiring conductors 30, 31 are formed in the through holes 26, 27, 28, 29, and the lands 23B, 24B, 30B, 31B and the connection bumps 32, 33, 34, 35 are formed on the lower surface of the stationary substrate 20 to complete the electrostatic microrelay as shown in FIG. 12(*e*).

As is apparent from the description given above, according to the electrostatic microrelay of the present invention, since the signal lines 23, 24 are passed through the silicon substrate 21 from the obverse surface to the reverse surface thereof, the signal line length can be shortened, so that the insertion loss of the electrostatic microrelay can be reduced. In particular, since the signal lines 23, 24 are formed vertically to the plane of the substrate, the effect of improving the insertion loss property can be maximized. Moreover, since the openings of the through holes 26, 27, 28, 29 are bonded to the fixed contact sealing portions 53, 54, the gap sealing portion 52 and the anchor 41A, and the fixed contacts 23A, 24A and the movable contact 48 are protected by sealing, reliability and the life of the electrostatic microrelay can be improved.

Moreover, since the wiring conductor 31 for driving the movable electrode 43 and the wiring conductor 30 for earthing the fixed electrode 22 are also passed through the silicon substrate 21 from the obverse surface to the reverse surface thereof, the signal lines 23, 24 and the wiring conductors 30, 31 are not formed on the upper surface of the stationary substrate 20 and the area of the fixed electrode 22 can be increased accordingly, so that the driving voltage can be suppressed.

Moreover, in the electrostatic microrelay of the present invention, since the bumps 32, 33, 34, 35 electrically continuous with the signal lines 23, 24 and the wiring conductors 30, 31 on the reverse surface side of the stationary substrate 20 are provided, the electrostatic microrelay can be directly mounted on the circuit board. That is, bonding wires for connection to the circuit board are unnecessary, so that a more excellent insertion loss property can be obtained. Further, since wire pads for connecting bonding wires, lead frames of the package and the like are unnecessary, the electrostatic microrelay and its mounting configuration can be reduced in size.

Further, by constructing the stationary substrate 20 and the movable substrate 40 of single-crystal silicon, all the manufacturing steps can be processed by semiconductor processing steps, so that dimensional accuracy variations can be suppressed. Moreover, since single-crystal silicon has high fatigue resistance and high creep resistance, longevity can be improved. Furthermore, since the stationary substrate 20 is made of single-crystal silicon, the through holes 26, 27, 28, 29 can be formed in the silicon substrate 21 with little dependence on substrate thickness by wet etching using DRIE or a (110) wafer.

Figure 13:
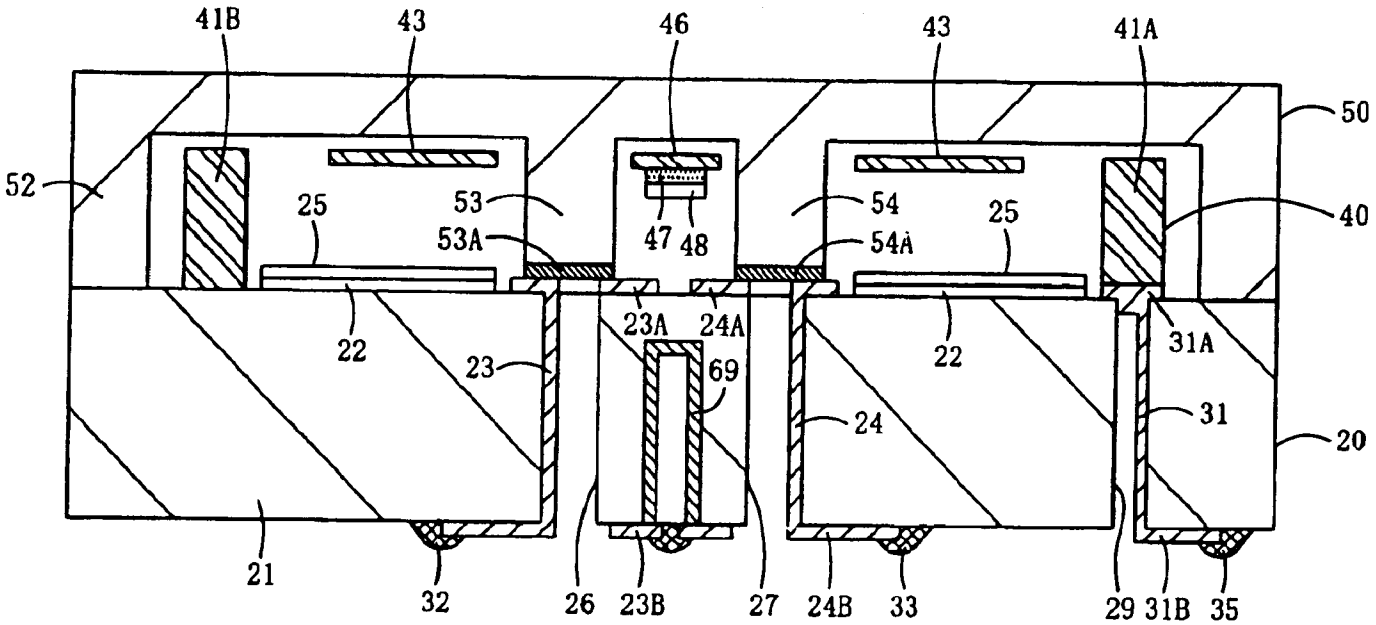
FIG. 13 is a stepped cross-sectional view showing the structure of an electrostatic microrelay according to another embodiment of the present invention.

Next, another embodiment of the present invention will be described. FIG. 13 is a cross-sectional view (a view of a stepped cross section corresponding to the cross section taken on X—X of FIG. 4) showing the structure of an electrostatic microrelay according to the embodiment of the present invention. In this embodiment, a ground line 69 for a high frequency is formed between the signal lines 23 and 24 electrically continuous with the fixed electrode 22 to thereby suppress the capacitive coupling between the signal lines 23 and 24. By thus suppressing the capacitive coupling between the signal lines 23 and 24, an excellent isolation property can be obtained. Moreover, this embodiment may be structured so that the signal lines 23, 24 and the wiring conductors 30, 31 are formed not on the entire circumferences of the through holes 26, 27, 28, 29 but on parts of the through holes 26, 27, 28, 29, that is, the signal lines 23, 24 or the wiring conductors 30, 31 are not formed on the halves on the sides close to each other. With this structure, the capacitive coupling between the signal lines 23 and 24 or the wiring conductors 30 and 31 can be suppressed, so that an excellent isolation property can be obtained.

In the above-described embodiments, when the movable substrate 40 is bonded to the stationary substrate 20 and when the cap 50 is bonded to the stationary substrate 20 integrated with the movable substrate 40, Au/Si bonding, anode bonding or silicon fusion bonding may be used.

Figure 14:
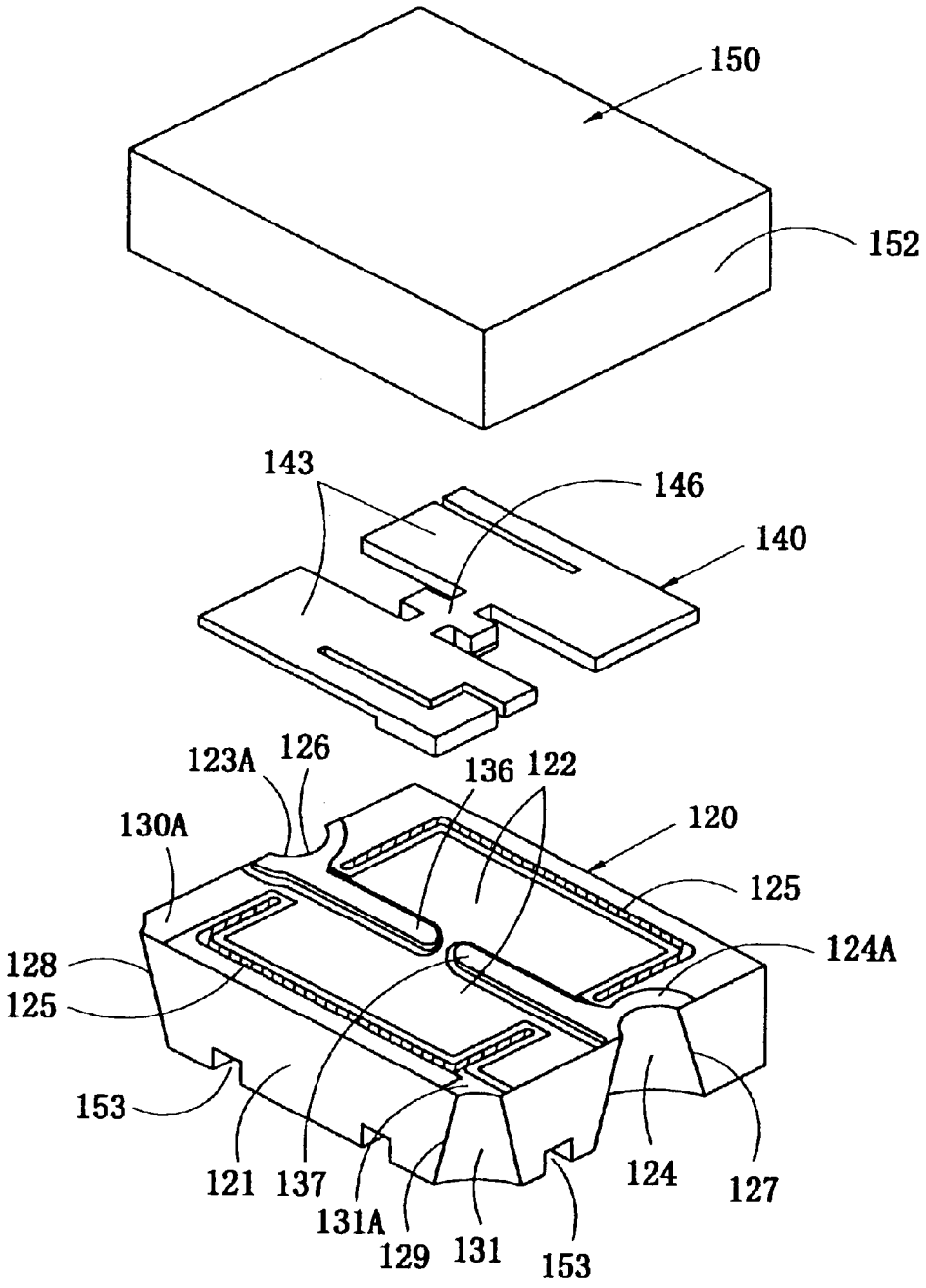
FIG. 14 is an exploded perspective view showing the structure of an electrostatic microrelay according to still another embodiment of the present invention.
Figure 15:
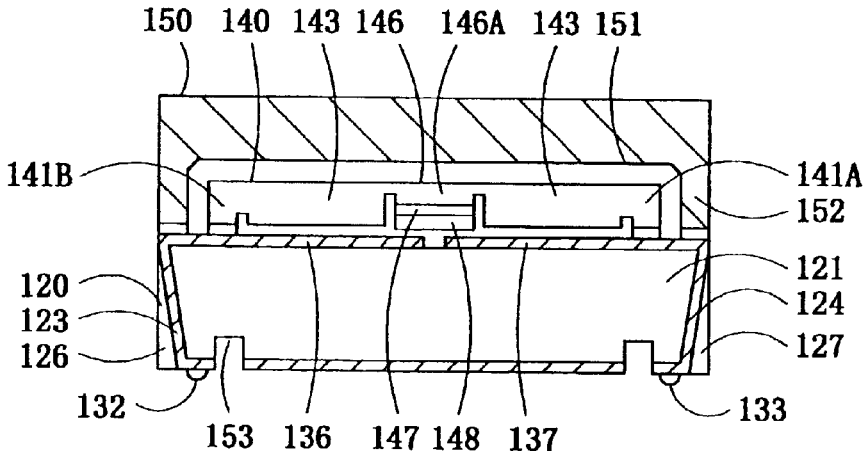
FIG. 15 is a schematic cross-sectional view of the electrostatic microrelay shown in FIG. 14.
Figure 16:
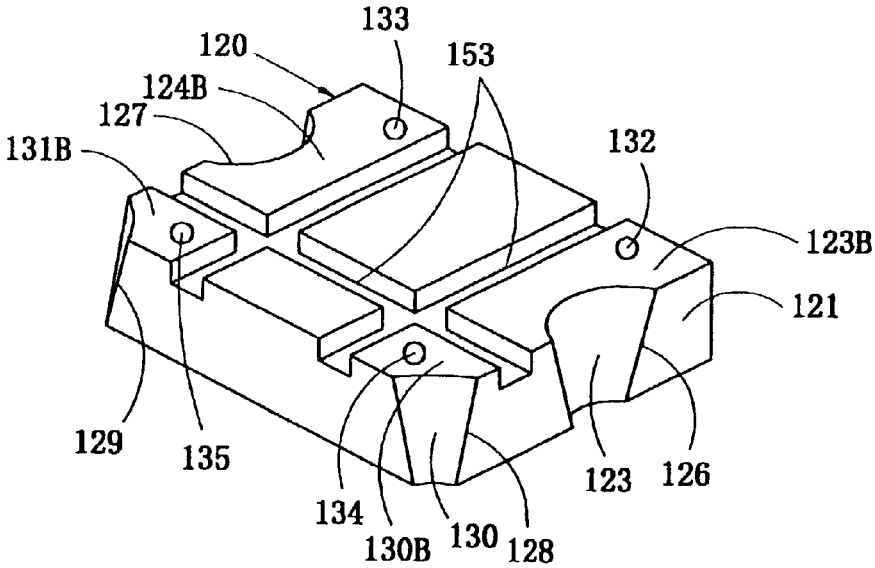
FIG. 16 is a perspective view of a reverse surface side of a stationary substrate used in the electrostatic microrelay of FIG. 14.
Figure 17:
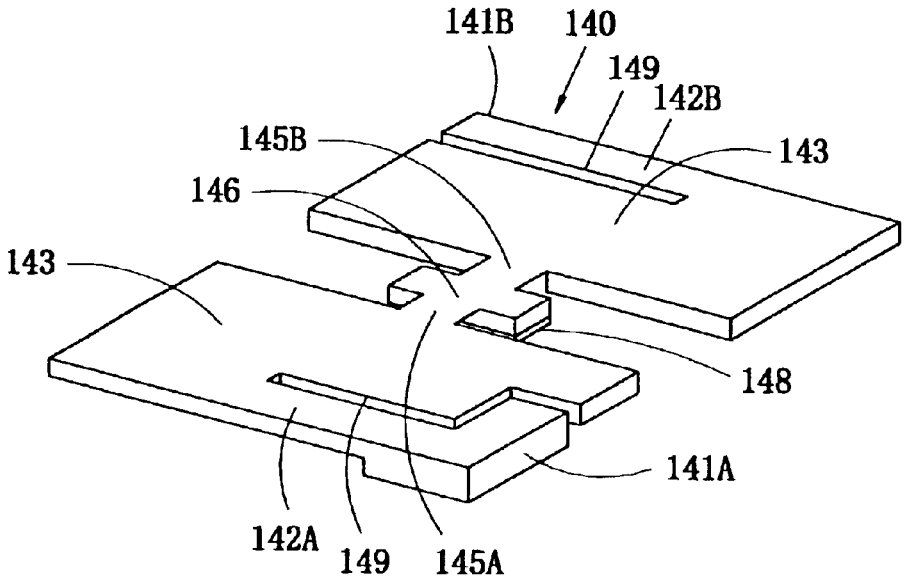
FIG. 17 is a perspective view of a movable substrate used in the electrostatic microrelay of FIG. 14.

Moreover, a glass substrate may be used as a substitute for the silicon substrate 21 constituting the stationary substrate 20. Since glass is an insulator, the capacitive coupling between the wiring conductors 30 and 31 can be suppressed by the use of a glass substrate Next, still another embodiment of the present invention will be described. FIG. 14 is an exploded perspective view showing the structure of an electrostatic microrelay according to the embodiment of the present invention. FIG. 15 is a cross-sectional view in a condition where the electrostatic microrelay is assembled. The electrostatic microrelay mainly comprises a stationary substrate 120, a movable substrate 140, and a cap 150. The movable substrate 140 is attached to the upper surface of the stationary substrate 120 so as to be integrated therewith. The upper surface of the stationary substrate 120 and the movable substrate 140 are sealed between the stationary substrate 120 and the cap 150. FIG. 16 is a perspective view of the stationary substrate viewed from the reverse surface side. FIG. 17 is a perspective view of the movable substrate 140.

In the stationary substrate 120, a fixed electrode 122 and a pair of fixed contacts 136, 137 are provided on the upper surface of a glass substrate 121. The fixed electrode 122 is surrounded by insulators 125 in a U shape. The insulators 125 are higher than the fixed electrode 122, and protrude above the surface of the fixed electrode 122. The pair of fixed electrodes 122 situated on both sides of the fixed contacts 136, 137 are connected through the gap between the fixed contacts 136 and 137. Moreover, in the stationary substrate 120, signal lines 123, 124 and wiring conductors 130, 131 are formed that comprise metal coatings provided on the inner surfaces of through grooves 126, 127, 128, 129 formed on sides and corners of the glass substrate 121. On the upper surface of the glass substrate 121, lands 123A, 124A, 130A, 131A are formed at edges of the signal lines 123, 124 and the wiring conductors 130, 131, respectively. The lands 123A, 124A, and the lands 130A, 131A are electrically isolated from each other.

Electrode films 123B, 124B, 130B, 131B isolated from one another are provided on the lower surface of the glass substrate 121 as shown in FIG. 16. The electrode films 123B, 124B, 130B, 131B are electrically continuous with the signal lines 123, 124 and the wiring conductors 130, 131, and are provided with connection bumps 132, 133, 134, 135, respectively. The fixed electrode 122 is electrically continuous with the land 130A, and is connected to the connection bump 134 through the wiring conductor 130 and the electrode film 130B. The fixed contacts 136, 137 of the stationary substrate 120 are electrically continuous with the lands 123A, 124A, respectively, and are connected to the connection bumps 132, 133 through the signal lines 123, 124 and the electrode films 123B, 124B, respectively.

The movable substrate 140 is formed by processing a substantially rectangular silicon substrate; and as shown in FIG. 17, resiliently supports a pair of substantially rectangular movable electrodes 143 by the anchors 141A, 141B through resilient bending portions 142A, 142B. The resilient bending portions 142A, 142B are formed by slits 149 formed along both side edges of the movable substrate 140. The anchors 141A, 141B protrude downward from the ends of the resilient bending portions 142A, 142B, respectively. The resilient supporting portions 145A, 145B and a movable contact portion 146 are formed between the movable electrodes 143. The resilient supporting portions 145A, 145B are narrow beams coupling the movable electrodes 143 and the movable contact portion 146, and are structured so that a larger resilience than that of the resilient bending portions 142A, 142B is obtained when the contacts are closed. In the movable contact portion 146, a movable contact 148 made of metal is provided, with an insulating film 147 in between, on the lower surface of a flat portion (silicon substrate portion) 146A directly supported by the resilient supporting portions 145A, 145B.

The movable substrate 140 is mounted on the stationary substrate 120 in the following manner: The anchors 141A, 141B protruding downward are fixed at two positions on the upper surface of the stationary substrate 120, whereby the movable electrodes 143 are supported so as to be floated above the stationary substrate 120. At this time, one anchor 141A is bonded onto the land 131A of the stationary substrate 120. Consequently, the movable electrodes 143 are electrically connected to the connection bump 135 provided on the reverse surface of the stationary substrate 120 with the wiring conductor 131 in between. The other anchor 141B is bonded to the upper surface of the glass substrate 121.

In the condition where the movable substrate 140 is mounted on the stationary substrate 120 in this manner, the movable electrodes 143 are opposed to the fixed electrode 122 and the insulator 125. When a voltage is applied between the electrodes 122 and 143 through the connection bumps 134, 135 and the wiring conductors 130, 131, the movable electrodes 143 are attracted to the fixed electrode 122 by the electrostatic attraction caused between the fixed electrode 122 and the movable electrodes 143. The movable contact 148 is opposed to the fixed contacts 136, 137, and makes contact with the fixed contacts 136, 137 to thereby close the fixed contacts 136, 137, so that the signal lines 123, 124 are electrically connected.

The cap 150 is made of a glass substrate such as Pyrex. As shown in FIG. 15, a concave portion 151 is formed on the lower surface of the cap 150. A gap sealing portion 152 surrounding the concave portion 151 is formed on the entire periphery of the cap 150. The gap sealing portion 152 is hermetically fixed to the upper surface of the periphery of the stationary substrate 120. Consequently, the fixed contacts 136, 137, the movable substrate 140 and the like on the upper surface of the stationary substrate 120 are hermetically sealed between the stationary substrate 120 and the cap 150 to be protected from dust and corrosive gases.

Next, the operation of the electrostatic microrelay will be described with reference to FIG. 18. In a condition where no voltage is applied between the fixed electrode 122 and the movable electrodes 143, as shown in FIG. 18(*a*), the stationary substrate 120 and the movable substrate 140 are kept parallel to each other, and the movable contact 148 is separated from the fixed contacts 136, 137.

When a voltage is applied between the movable electrodes 143 and the fixed electrode 122 from the connection bumps 134, 135, electrostatic attraction is caused between the electrodes 122 and 143. Consequently, as shown in FIG. 18(*b*), the movable electrodes 143 approach the fixed electrode 122 against the resilience of the resilient bending portions 142A, 142B, so that the movable contact 148 abuts against the fixed contacts 136, 137.

Figures 18A, 18B, 18C:
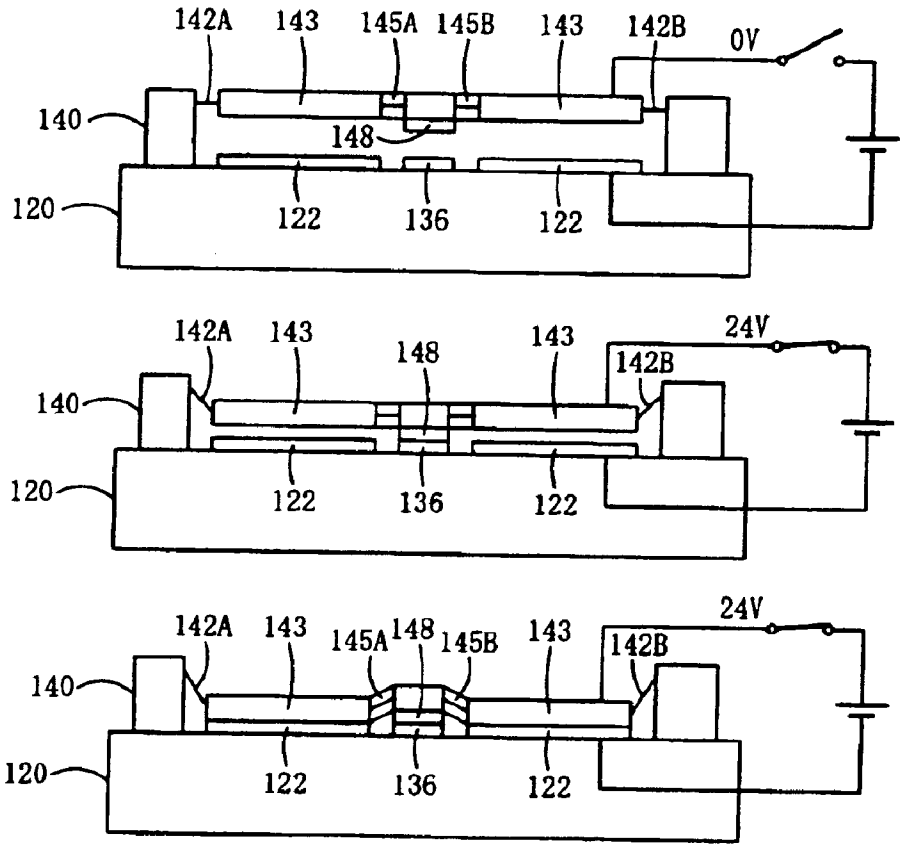
FIGS. 18(*a*), 18(*b*) and 18(*c*) are schematic views explaining the operation of the electrostatic microrelay of FIG. 14.
Figure 19A:
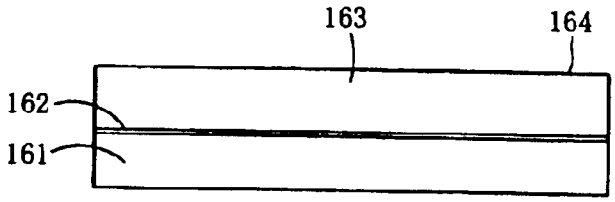
FIG. 19(*a*) through FIG. 19(*e*) are schematic views explaining the steps of manufacturing the movable substrate used in the electrostatic microrelay of FIG. 14.
Figure 19B:
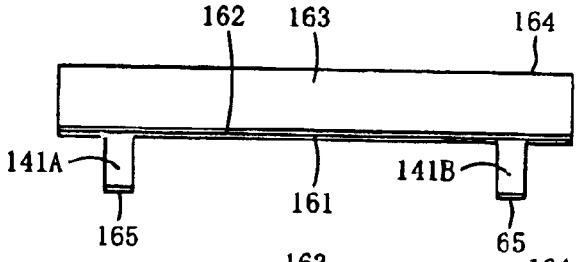
Figure 19C:
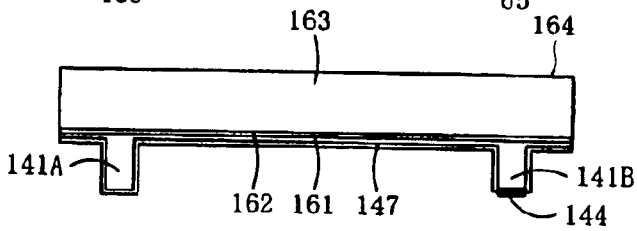
Figure 19D:
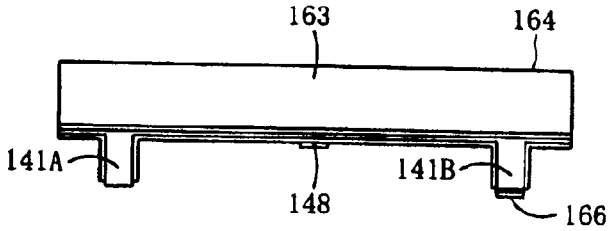
Figure 19E:
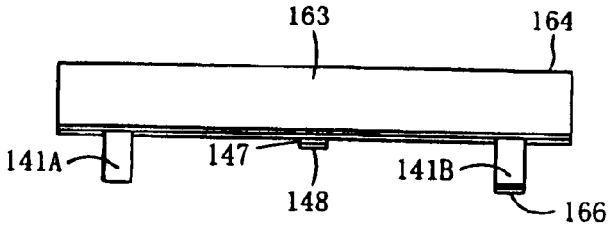
Figure 20A:
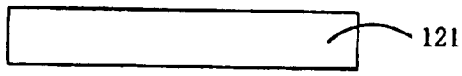
FIG. 20(*a*) through FIG. 20(*e*) are schematic views for explaining the steps of manufacturing the stationary substrate used in the electrostatic microrelay of FIG. 14.
Figure 20B:
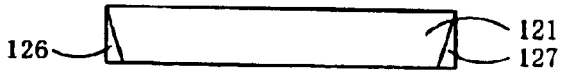
Figure 20C:
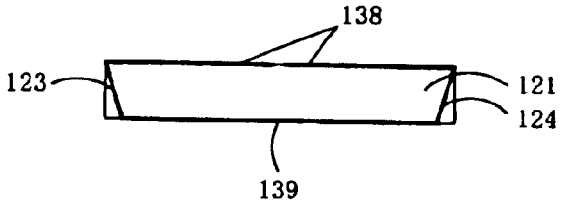
Figure 20D:
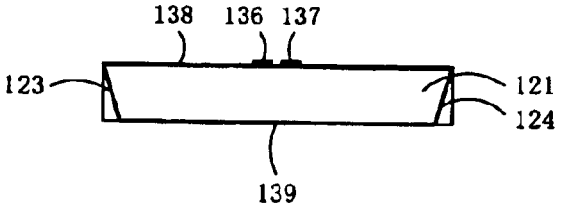
Figure 20E:
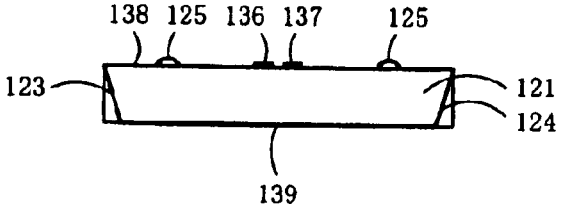

As shown in FIG. 18(*c*), even after the movable contact 148 abuts against the fixed contacts 136, 137, the movable electrodes 143 continue moving until abutting against the insulator 125 around the fixed electrode 122. Because of this, the movable contact 148 exerts a resilience corresponding to the amount of bend of the resilient supporting portions 145A, 145B on the fixed contacts 136, 137 to increase the contact pressure, so that the movable substrate 140 uniformly abuts against the stationary substrate 120. As a result, a desired contact reliability is obtained when the contacts are closed.

When the applied voltage is removed, the movable electrodes 143 are separated from the fixed electrode 122 by the resiliences of both of the resilient bending portions 142A, 142B and the resilient supporting portions 145A, 145B. Because of this, the separating operation is performed with reliability. Thereafter, the movable electrodes 143 continue moving upward by the resilience of only the resilient bending portions 142A, 142B, and the movable contact 148 is separated from the fixed contacts 136, 137 to return to the initial state.

Next, a method for manufacturing the electrostatic microrelay having the above-described structure will be described with reference to FIG. 19 through FIG. 22. First, an intermediate product of the movable substrate 140 is made according to FIG. 19. That is, as shown in FIG. 19(*a*), an SOI (Silicon On Insulator) wafer 164 comprising an Si layer 161, an $SiO_2$ layer (oxide film) 162 and an Si layer 163 from below is prepared. Then, to form the anchors 141A, 141B on the lower surface of the Si layer 161, the lower surface of the Si layer 161 is wet-etched, for example, with a silicon oxide film 165 as the mask and TMAH as the etchant, thereby forming the anchors 141A, 141B protruding downward as shown in FIG. 19(*b*). Then, as shown in FIG. 19(*c*), after the insulating film 147 made of $SiO_2$ is formed by thermally oxidizing the lower surface of the silicon layer 161, the lower surface of one anchor 141B is exposed out of the insulating film 147, and P (phosphorus) is poured into the exposed surface to form a conductive layer 144. Then, as shown in FIG. 19(*d*), after the lower surface of the other anchor 141A is opened, a metal film 166 of Au or the like is provided on the lower surface of the anchor 141B, and at the same time, the movable contact 148 of Au or the like is formed on the insulating film 147 substantially in the center of the lower surface of the Si layer 161. Then, the insulating film 147 is removed by etching. The insulating film 147 on the lower surface of the movable contact 148 is left without being etched, because it is covered with the movable contact 148. Consequently, a two-layer structure of the insulating film 147 and the movable contact 148 is formed.

Next, the stationary substrate 120 is formed according to the steps of FIG. 20. That is, the glass substrate 121 as shown in FIG. 20(*a*) is prepared, and sandblasting is performed on the glass substrate 121 to thereby form the through grooves 126, 127, 128, 129 in a total of four positions on both sides and the corners as shown in FIG. 20(*b*). Then, as shown in FIG. 20(*c*), electrode films 138, 139 are formed on the obverse and reverse surfaces of the glass substrate 121 by a method such as sputtering, vapor deposition or plating. At the same time, electrode films are formed on the inner surfaces of the through grooves 126, 127, 128, 129 by a method such as sputtering, vapor deposition or plating to thereby form the signal lines 123, 124 and the wiring conductors 130, 131. Then, as shown in FIG. 20(*d*), the fixed contacts 136, 137, the fixed electrode 122 and the lands 123A, 124A, 130A, 131A are formed by patterning the electrode film 138 on the surface of the glass substrate 121, and as shown in FIG. 20(*e*), the insulators 125 are formed around the fixed electrode 122.

Figure 21A:
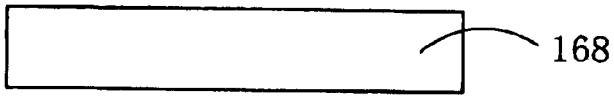
FIG. 21(*a*) and FIG. 21(*b*) are schematic views explaining the steps of manufacturing a cap used in the electrostatic microrelay of FIG. 14.
Figure 21B:
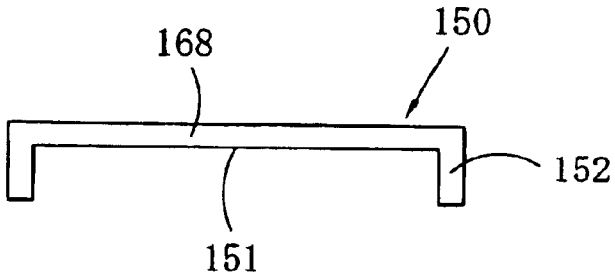
Figure 22A:
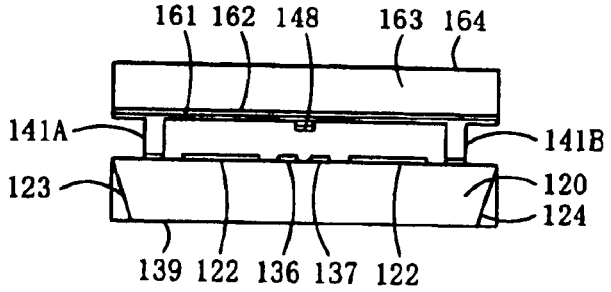
FIG. 22(*a*) through FIG. 22(*e*) are schematic views explaining the steps of manufacturing the electrostatic microrelay by joining together the movable substrate, the stationary substrate and the cap manufactured according to the steps of FIG. 19, FIG. 20 and FIG. 21.
Figure 22B:
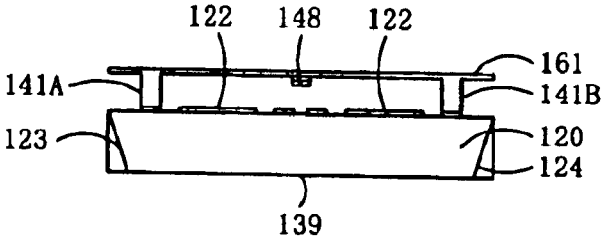
Figure 22C:
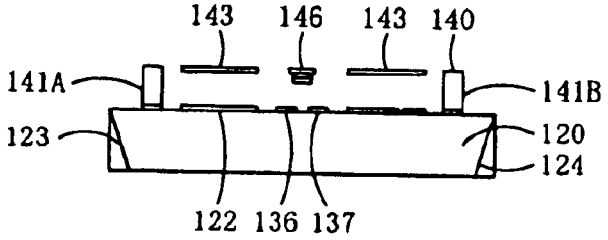
Figure 22D:
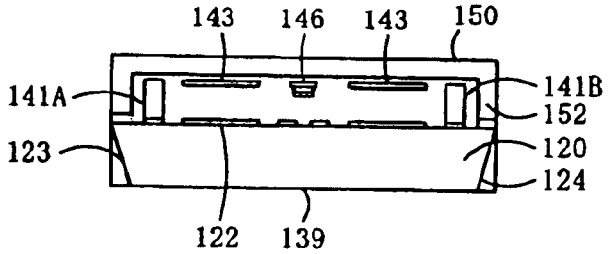
Figure 22E:
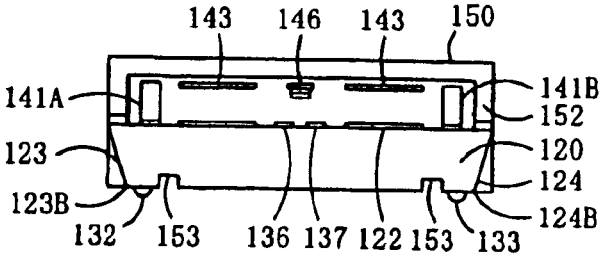

The cap 150 is formed according to the steps of FIG. 21. For this, a glass substrate 168 as shown in FIG. 21(*a*) is prepared, and the glass substrate 168 is wet-etched from below, for example, with Cr as the mask and HF as the etchant to thereby form the concave portion 151 on the lower surface of the glass substrate 168, and the gap sealing portion 152 is formed therearound.

Then, as shown in FIG. 22(*a*), the SOI wafer 164 is placed on the stationary substrate 120, and the anchors 141A, 141B are integrally bonded to the land 131A and the glass substrate 121 of the stationary substrate 120. Then, the upper surface of the SOI wafer 164 is etched with an alkaline etchant such as TMAH or KOH. The upper surface is etched until the $SiO_2$ layer 162 is reached so that the $SiO_2$layer 162 is exposed. Consequently, the Si layer 161 which is thin is formed above the stationary substrate 120 except for parts of the anchors 141A, 141B.

Then, the oxide film 162 on the Si layer 161 is removed by use of a fluorine etchant so that the Si layer 161 that becomes the movable electrodes 143 are exposed as shown in FIG. 22(*b*). Then, the unnecessary portion on the periphery is removed by performing mold etching by dry etching using RIE or the like, and the slits 149 and the like are processed to form the resilient bending portions 142A, 142B, the resilient supporting portions 145A, 145B and the movable contact portion 146 to complete the movable substrate 140 on the stationary substrate 120 as shown in FIG. 22(*c*).

Then, as shown in FIG. 22(*d*), the cap 150 is placed over the stationary substrate 120 integrally bonded to the movable substrate 140, and the gap sealing portion 152 is integrally bonded to the periphery of the upper surface of the stationary substrate 120 by frit bonding. Then, as shown in FIG. 22(*e*), the connection bumps 132, 133, 134, 135 are formed on the reverse surface of the stationary substrate 120, and by forming electrode film separating slits 153 on the reverse surface of the stationary substrate 120 and separating the electrode film 139 on the reverse surface, the electrode films 123B, 124B, 130B, 131B are formed to complete the electrostatic microrelay.

According to this electrostatic microrelay, like the first embodiment, the signal line length can be shortened, so that the insertion loss of the electrostatic microrelay can be reduced. Consequently, the high frequency property improves. In particular, since the signal lines 123, 124 are formed vertically to the plane of the substrate, the effect of improving the insertion loss property can be maximized. Moreover, since the through grooves 126, 127, 128, 129 are provided on the periphery of the stationary substrate 120 and are situated outside the space sealed by the cap 150, the fixed contacts 136, 137 and the movable contact 148 are protected by sealing, so that reliability and the life of the electrostatic microrelay can be improved.

Moreover, in the electrostatic microrelay of the present invention, since the bumps 132, 133, 134, 135 electrically continuous with the signal lines 123, 124 and the wiring conductors 130, 131 on the reverse surface side of the stationary substrate 120 are provided, the electrostatic microrelay can be directly mounted on the circuit board. That is, bonding wires for connection to the circuit board are unnecessary, so that a more excellent insertion loss property can be obtained. Further, since wire pads for connecting bonding wires, lead frames of the package and the like are unnecessary, the electrostatic microrelay and its mounting configuration can be reduced in size. Consequently, the mounting area can be significantly reduced, and an extremely excellent high frequency property (low insertion loss) can be realized because the transmission line length can be significantly reduced.

To bond the movable substrate 140 and the stationary substrate 120, metal bonding such as Au/Au bonding may be used, or anode bonding may be used. Moreover, a silicon substrate or a ceramic substrate may be used as a substitute for the glass substrate 121 constituting the stationary substrate 120. Moreover, when the stationary substrate 120 is made of a silicon substrate, anisotropic etching or dry etching may be used to form the through grooves. Further, when the stationary substrate 120 is obtained from a silicon wafer, the through grooves may be obtained by dividing through holes formed in the silicon wafer into two or four parts.

Figure 23:
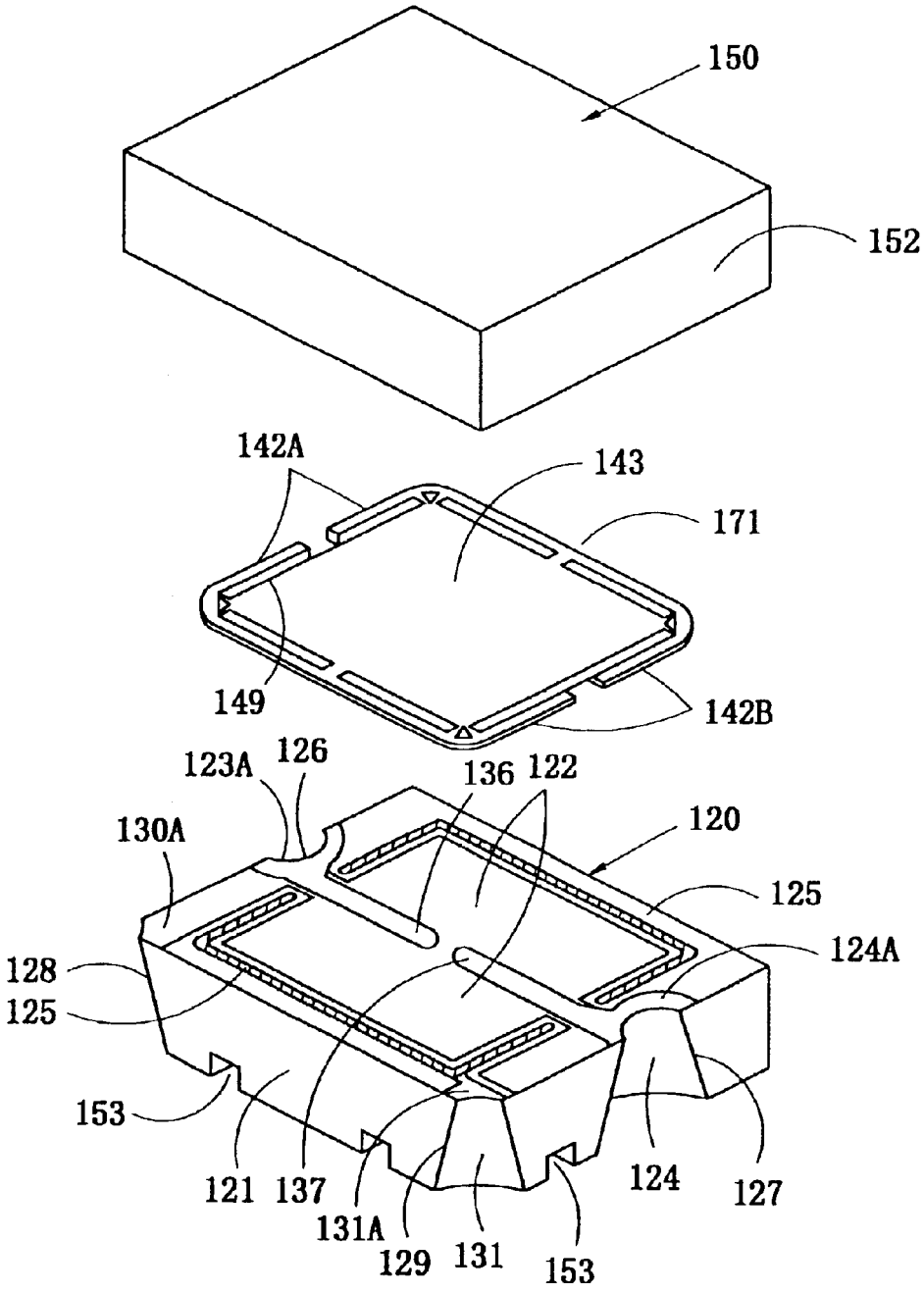
FIG. 23 is an exploded perspective view showing the structure of an electrostatic microrelay according to still another embodiment of the present invention.
Figure 24:
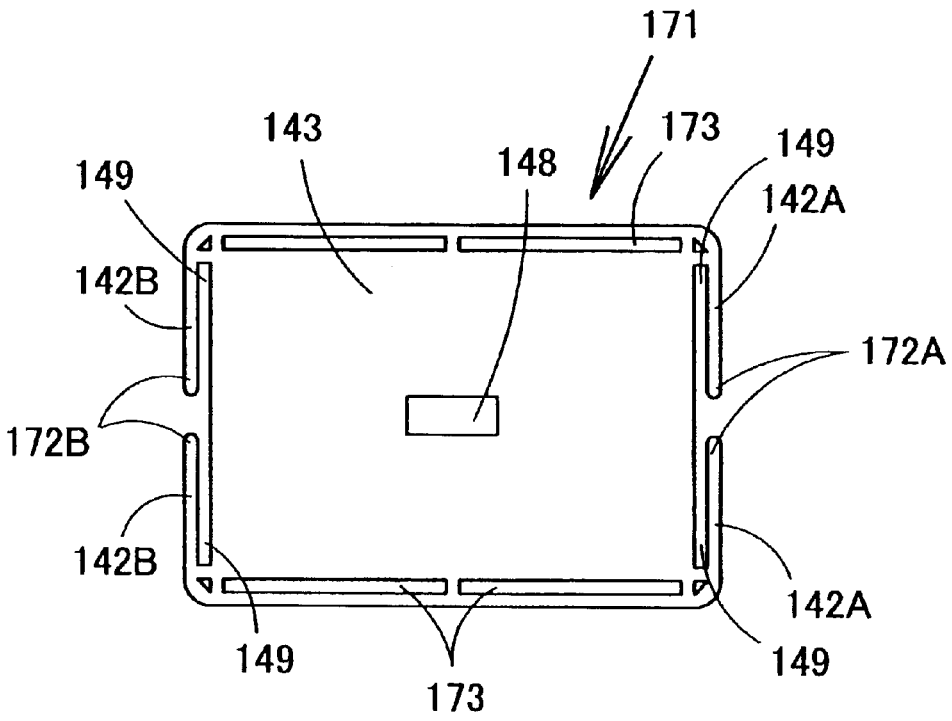
FIG. 24 is a reverse surface view of a movable substrate used in the electrostatic microrelay of FIG. 23.

Next, still another embodiment of the present invention will be described. FIG. 23 is an exploded perspective view of an electrostatic microrelay according to still another embodiment of the present invention. The stationary substrate 120 used in this electrostatic microrelay is the same as that used in the electrostatic microrelay of the third embodiment (FIG. 14). FIG. 24 is a bottom view of a movable substrate 171 used in this electrostatic microrelay. The movable substrate 171 is formed by processing a substantially rectangular silicon substrate or thin stainless steel plate, and four resilient bending portions 142A, 142B are formed by slits 149 on both ends of the movable substrate 171. Moreover, elongate holes 173 for facilitating deformation of the movable substrate 171 are formed on both sides of the movable substrate 171. Further, a movable contact 148 is formed, with an insulating film 147 in between, in the center of the lower surface of a movable electrode 143 provided on the movable substrate 171.

Figure 25:
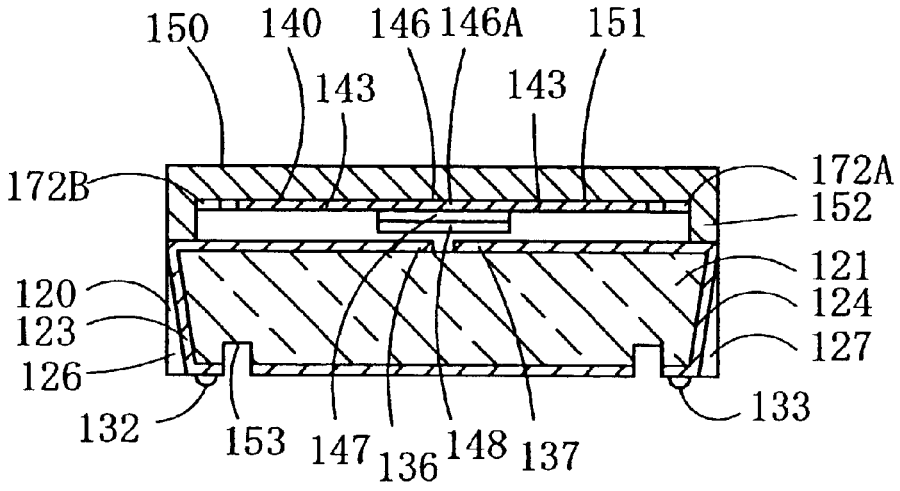
FIG. 25 is a cross-sectional view of the electrostatic microrelay shown in FIG. 23.

The movable substrate 171 has a structure such that tip ends 172A, 172B of the resilient bending portions 142A, 142B are bonded to the top surface of a concave portion 151 of the cap 150 as shown in FIG. 25, and when electromagnetic attraction acts between the movable electrode 143 and the fixed electrode 122, the resilient bending portions 142A, 142B are bent to move the movable electrode 143 and the movable contact 148 downward, so that the movable contact 148 makes contact with fixed contacts 136, 137.

The electrostatic microrelay of the present invention can be used in various apparatuses, in particular, in communications apparatuses. For example, it can be used as switching elements of mobile telephones, transmission/reception portions of wireless communications terminals, diversity antennas, indoor and outdoor antennas, multiband antennas and the like. By using the electrostatic microrelay for these purposes, the insertion loss is small compared to a case where a conventionally used MMIC switch or the like is used, so that the battery lives of communications terminals can be increased. Moreover, by using the electrostatic microrelay as various switching elements provided in antenna portions of wireless communications base stations of mobile telephones and the like, the switching elements are small in size compared to a case where a conventionally used electromagnetic relay is used, so that the base stations can be reduced in size.

Figure 26:
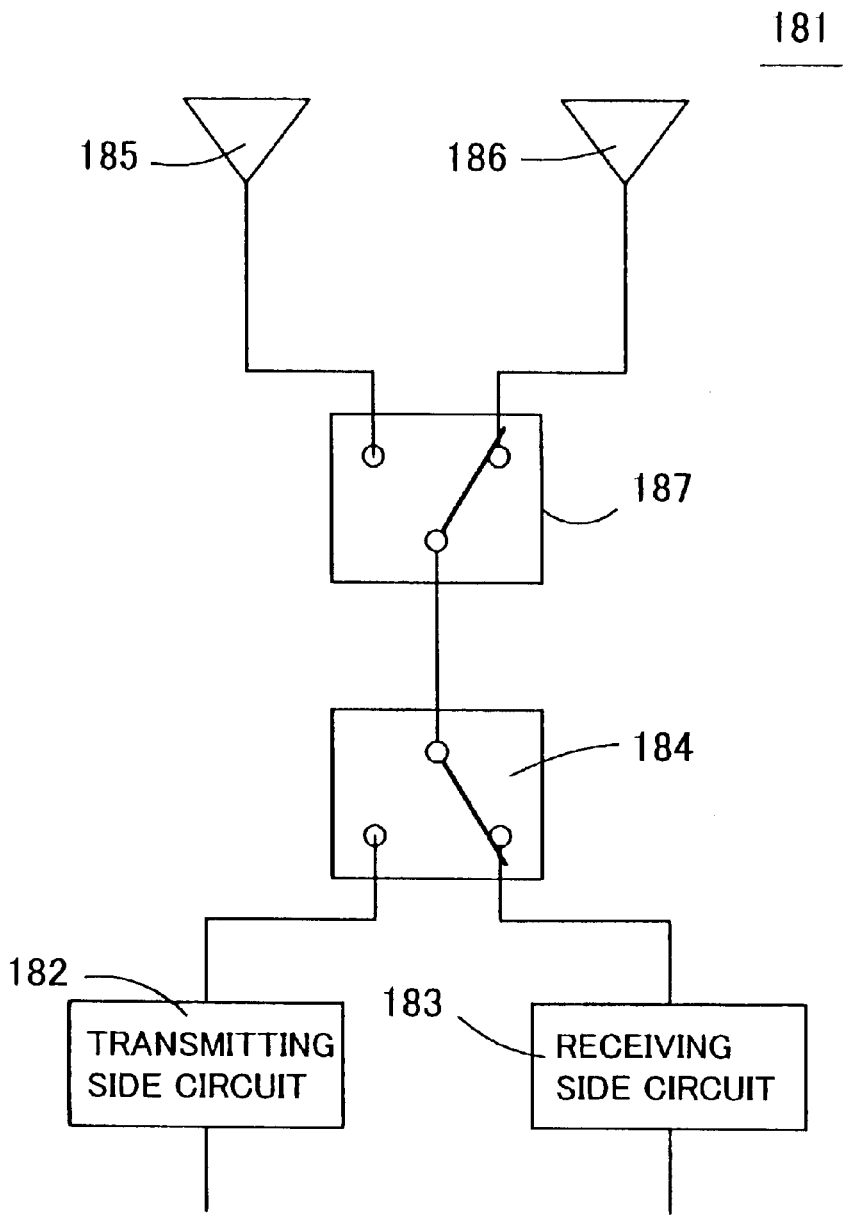
FIG. 26 is a view showing a case where the microrelay of the present invention is used as a changeover switch in a wireless communications terminal such as a mobile telephone.

FIG. 26 shows a case where the electrostatic microrelay of the present invention is used as a changeover switch in a wireless communications terminal 181 such as a mobile telephone. The electrostatic microrelay of the present invention is used as a transmission/reception switch 184 switching between a transmitting side circuit 182 and a receiving side circuit 183. The electrostatic microrelay of the present invention is also used as a diversity switch 187 switching between a main antenna 185 and a diversity antenna 186. Although not shown, the electrostatic microrelay of the present invention may be used as an antenna switch switching between a main antenna and an external antenna.

Figure 27:
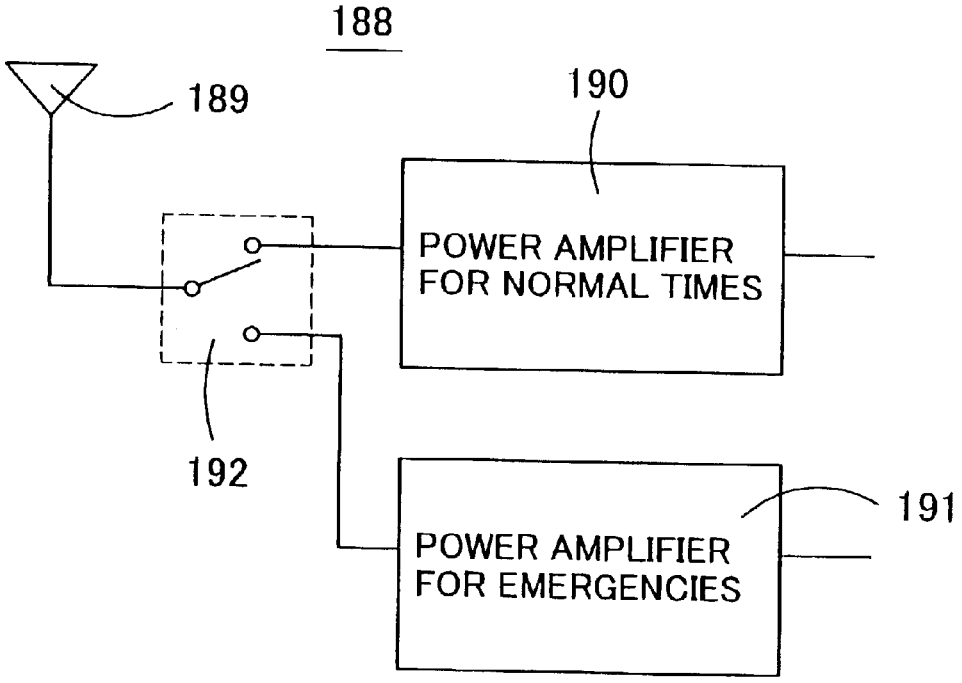
FIG. 27 is a view showing an example in which the electrostatic microrelay of the present invention is used in a wireless communications base station.

FIG. 27 shows an example in which the electrostatic microrelay of the present invention is used in a wireless communications base station 188. In this example, an antenna 189 is connected to a power amplifier 190 for normal times and a power amplifier 191 for emergencies so as to be switchable by a switching element (switch) 192 in which the electrostatic microrelay of the present invention is used. In the event of an emergency such as a failure, switching from the power amplifier 190 for normal times to the power amplifier 191 for emergencies can be made swiftly.

INDUSTRIAL APPLICABILITY

The electrostatic relay of the present invention is used, for example, as switching elements of mobile telephones, transmission/reception portions of wireless communications terminals, diversity antennas, indoor and outdoor antennas, multiband antennas and the like. Moreover, the electrostatic relay of the present invention is also used as switching elements provided in antenna portions of wireless communications base stations of mobile telephones and the like.

What is claimed is:

1. An electrostatic relay, comprising:

a movable electrode of a movable substrate resiliently supported so as to be opposed to a fixed electrode formed on a stationary substrate, wherein the movable electrode is driven based on electrostatic attraction caused between the fixed electrode and the movable electrode;

a plurality of fixed contacts provided on the stationary substrate and a movable contact provided on the movable substrate, wherein the fixed contacts and the movable contact are capable of being brought into contact with each other and separated from each other;

a cap substrate having a portion that crosses a line connecting the fixed contacts and the movable contact outside a gap between the fixed contacts and the movable contact, and wherein the cap substrate is arranged to enclose at least the fixed contacts and the movable contact by sealing the moveable substrate between a top surface of the stationary substrate and the cap substrate; and a through portion in which at least one of the signal lines connecting to the fixed contacts is passed through the stationary substrate from an obverse surface to a reverse surface thereof and is disposed in a position not deteriorating a sealing condition of the cap substrate.

2. An electrostatic relay according to claim 1, wherein at least one of the signal lines connecting to the fixed contacts is passed through the stationary substrate from the obverse surface to the reverse surface thereof, and an opening, on a movable substrate bonded side, of a through hole through which the signal line is passed is hermetically sealed by bonding it to the movable substrate or to the third substrate through a metal layer formed around the opening.

3. An electrostatic relay according to claim 2, wherein at least one of the signal lines passed through the stationary substrate from the obverse surface to the reverse surface thereof is formed vertically to the stationary substrate.

4. An electrostatic relay according to claim 2, wherein at least one of the wiring conductors provided on the stationary substrate, except for the signal lines connecting to the fixed electrodes being passed through the stationary substrate from the obverse surface to the reverse surface thereof, and an opening on the movable substrate bonded side of a through hole through which the wiring conductor is passed, is hermetically sealed by bonding it to the movable substrate or to the third substrate through a metal layer formed around the opening.

5. An electrostatic relay according to claim 2 or 4, wherein at least one ground line for high frequency is formed between at least one pair of signal lines or wiring conductors of the signal lines or the wiring conductors formed on the stationary substrate.

6. An electrostatic relay according to claim 2 or 4, wherein at least one of the signal lines or the wiring conductors is formed in the through hole formed in the stationary substrate, and at least one of the signal line or the wiring conductor is formed only on part of the through hole.

7. An electrostatic relay according to claim 2 or 4, wherein at least one of bumps is provided at an end situated on a substrate's reverse surface side of at least one of the signal lines or the wiring conductors formed on the stationary substrate.

8. An electrostatic relay according to claim 2, wherein the opening is disposed outside an area on the stationary substrate opposed to the movable electrode or the movable contact.

9. An electrostatic relay according to claim 2, wherein the cap substrate is bonded to the stationary substrate by a convex portion formed on a side bonded to the stationary substrate.

10. An electrostatic relay according to claim 9, wherein at least one of the openings is disposed in a position opposed to the convex portion of the cap substrate.

11. An electrostatic relay according to claim 1, wherein the through portion is disposed in a peripheral part of the stationary substrate.

12. An electrostatic relay according to claim 11, wherein the through portion is a concave shape having an opening on a periphery of the stationary substrate.

13. An electrostatic relay according to claim 11, wherein the through portion is formed vertically to a plane of the stationary substrate.

14. An electrostatic relay according to claim 11, wherein the cap substrate is bonded to the stationary substrate, and the through portion is provided on the stationary substrate in a neighborhood outside an area of bonding of the stationary substrate and the cap substrate.

15. An electrostatic relay according to claim 11, wherein at least one of the wiring conductors formed on the stationary substrate is connected to the through portion.

16. An electrostatic relay according to claim 11, wherein an electrode film is provided on the reverse surface of the stationary substrate, and the electrode film is divided into a plurality of areas isolated from each other, by a slit formed on the reverse surface of the stationary substrate.

17. An electrostatic relay according to claim 11, wherein at least one of bumps electrically continuous with at least one of the signal lines or the wiring conductors formed on the stationary substrate is provided on the reverse surface of the stationary substrate.

18. An electrostatic relay according to claim 1, wherein the stationary substrate and the movable substrate are made of single-crystal silicon.

19. A communications apparatus having a switching element that switches transmission/reception signals of an antenna or an internal circuit, wherein the electrostatic relay according to claim 1 is used as the switching element.

* * * * *